US011053661B2

(12) United States Patent
Kikuchi et al.

(10) Patent No.: US 11,053,661 B2
(45) Date of Patent: Jul. 6, 2021

(54) WORK MACHINE

(71) Applicant: HITACHI CONSTRUCTION MACHINERY CO., LTD., Tokyo (JP)

(72) Inventors: Jun Kikuchi, Ushiku (JP); Seiji Ishida, Hitachinaka (JP); Manabu Edamura, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 315 days.

(21) Appl. No.: 16/329,236

(22) PCT Filed: Nov. 20, 2017

(86) PCT No.: PCT/JP2017/041728
§ 371 (c)(1),
(2) Date: Feb. 28, 2019

(87) PCT Pub. No.: WO2018/179577
PCT Pub. Date: Oct. 4, 2018

(65) Prior Publication Data

US 2019/0249391 A1 Aug. 15, 2019

(30) Foreign Application Priority Data

Mar. 29, 2017 (JP) ..... JP2017-066001

(51) Int. Cl.
*E02F 3/43* (2006.01)
*E02F 3/84* (2006.01)
(Continued)

(52) U.S. Cl.
CPC ..... *E02F 3/43* (2013.01); *E02F 3/845* (2013.01); *E02F 9/20* (2013.01); *E02F 9/22* (2013.01);
(Continued)

(58) Field of Classification Search
CPC ... E02F 3/43; E02F 3/845; E02F 9/264; E02F 9/2221; E02F 9/2004
See application file for complete search history.

(56) References Cited

U.S. PATENT DOCUMENTS 5,835,874 A 11/1998 Hirata et al.
6,061,617 A 5/2000 Berger et al.
(Continued)

FOREIGN PATENT DOCUMENTS

GB 2506281 A 3/2014
JP 07-243225 A 9/1995
(Continued)

OTHER PUBLICATIONS

International Preliminary Report on Patentability received in corresponding International Application No. PCT/JP2017/041728 dated Oct. 10, 2019.
(Continued)

*Primary Examiner* — Ramsey Refai
(74) *Attorney, Agent, or Firm* — Mattingly & Malur, PC

(57) ABSTRACT

A work machine includes: a satellite communication antenna for detecting a position of an upper swing structure; angle sensors detecting postures of two work devices; position computing devices that calculate postures/positions of the two work devices on the basis of outputs from the satellite communication antenna and the angle sensors; a display device on which the position of at least one work device of the two work devices and a position of a target surface are displayed; a display selection switch that outputs a first input signal for displaying a work device selected by an operator from between the two work devices on the display device; and a display changeover section that displays the work device corresponding to the first input signal input from the display selection switch out of the two work devices and the
(Continued)

position of the target work object of the work device on the display device.

9 Claims, 20 Drawing Sheets

(51) Int. Cl.
*E02F 9/26* (2006.01)
*E02F 9/22* (2006.01)
*E02F 9/20* (2006.01)

(52) U.S. Cl.
CPC ..... *E02F 9/2221* (2013.01); *E02F 9/26* (2013.01); *E02F 9/264* (2013.01); *E02F 9/2004* (2013.01)

(56) References Cited

U.S. PATENT DOCUMENTS

| | | | | |
|---|---|---|---|---|
| 6,064,918 | A | 5/2000 | Ohtsukasa et al. | |
| 8,191,290 | B2 * | 6/2012 | Hughes, IV | E02F 9/2232 37/348 |
| 8,272,467 | B1 * | 9/2012 | Staab | E02F 9/26 180/167 |
| 8,768,580 | B2 * | 7/2014 | Mizuochi | E02F 9/264 701/50 |
| 2009/0159302 | A1 | 6/2009 | Koch et al. | |
| 2014/0064897 | A1 * | 3/2014 | Montgomery | E02F 9/262 414/685 |
| 2014/0100712 | A1 * | 4/2014 | Nomura | E02F 9/264 701/1 |
| 2015/0368876 | A1 * | 12/2015 | Nakagaki | E02F 3/435 701/50 |
| 2016/0237654 | A1 | 8/2016 | Arimatsu et al. | |
| 2016/0251824 | A1 | 9/2016 | Arimatsu et al. | |
| 2016/0265196 | A1 * | 9/2016 | Shimizu | E02F 3/325 |
| 2017/0107688 | A1 | 4/2017 | Fujii et al. | |

FOREIGN PATENT DOCUMENTS

| | | | |
|---|---|---|---|
| JP | 10-219728 | A | 8/1998 |
| JP | 3056254 | B2 | 6/2000 |
| JP | 2013-007199 | A | 1/2013 |
| JP | 5364741 | B2 | 12/2013 |
| WO | 2015/173935 | A1 | 11/2015 |
| WO | 2015/186201 | A1 | 12/2015 |
| WO | 2016/052762 | A1 | 4/2016 |

OTHER PUBLICATIONS

Extended European Search Report received in corresponding European Application No. 17903017.6 dated Nov. 27, 2020.
International Search Report of PCT/JP2017/041728 dated Jan. 16, 2018.

* cited by examiner

WORK MACHINE

TECHNICAL FIELD

The present invention relates to a work machine provided with a plurality of work devices.

BACKGROUND ART

As a technique used for improvement of work efficiency of a work machine (for example, a hydraulic excavator) provided with a work device (for example, a front work device) driven by hydraulic actuators, there are known Machine Guidance (MG) and Machine Control (MC). The MG is a technique for improving workability by indicating a position of a target work object and a position of the work device obtained from work execution information on a display mounted in the work machine (for example, Japanese Patent No. 5364741). On the other hand, the MC is a technique for assisting operator's operating a work device by executing semiautomatic control for actuating the work device in accordance with a preset condition in a case in which an operator's operation is input (for example, Japanese Patent No. 3056254).

PRIOR ART DOCUMENT

Patent Documents

Patent Document 1: Japanese Patent No. 5364741
Patent Document 2: Japanese Patent No. 3056254

SUMMARY OF THE INVENTION

Problem to be Solved by the Invention

Meanwhile, a work machine is often provided with a plurality of work devices. For example, a hydraulic excavator is provided with not only a front work device having a boom, an arm, and a bucket but also a blade work device (blade) for ground leveling work in front of a lower travel structure. In a case of causing at least one of the MG and the MC to function over each of the work devices of the work machine of this type, there is a concern of a decline in work efficiency due to the fact that at least one of the MG and the MC over the operator's unintended work device becomes valid or the like unless the work device suited for a work content is selected from among the plurality of work devices to execute at least one of the MG and the MC over the selected work device. It is noted that "at least one of the MG and the MC" is also referred to as the "MG and/or MC" hereinafter.

The present invention has been achieved in the light of the above respects and an object of the present invention is to provide a work machine that can select a work device suited for a work content from among a plurality of work devices and that can execute MG and/or MC over the selected work device.

Means for Solving the Problem

While the present application includes a plurality of means for solving the problems, an example of the plurality of means is as follows. There is provided a work machine including: a plurality of work devices; an operation device for operating the plurality of work devices; a position sensor that detects a position of a machine body to which the plurality of work devices are attached; a plurality of posture sensors that detect postures of the plurality of work devices; and a controller having a position computing device that calculates positions of the plurality of work devices on the basis of outputs from the position sensor and the plurality of posture sensors. The work machine includes: a display device on which a position of at least one work device among the plurality of work devices and a position of a target work object of the at least one work device are displayed; and a display selection device that is used for an operator to select a work device to be displayed on the display device from among the plurality of work devices, the display selection device outputting a first input signal for causing the work device selected by the operator to be displayed on the display device, and the controller further includes a display changeover section that selectively causes the work device corresponding to the first input signal input from the display selection device among the plurality of work devices to be displayed and causes the position of the target work object of the work device corresponding to the first input signal input from the display selection device to be displayed on the display device.

Advantage of the Invention

According to the present invention, MG and/or MC is executed over a work device suited for a work content among a plurality of work devices; thus, it is possible to improve work efficiency.

MODES FOR CARRYING OUT THE INVENTION

Figure 1:
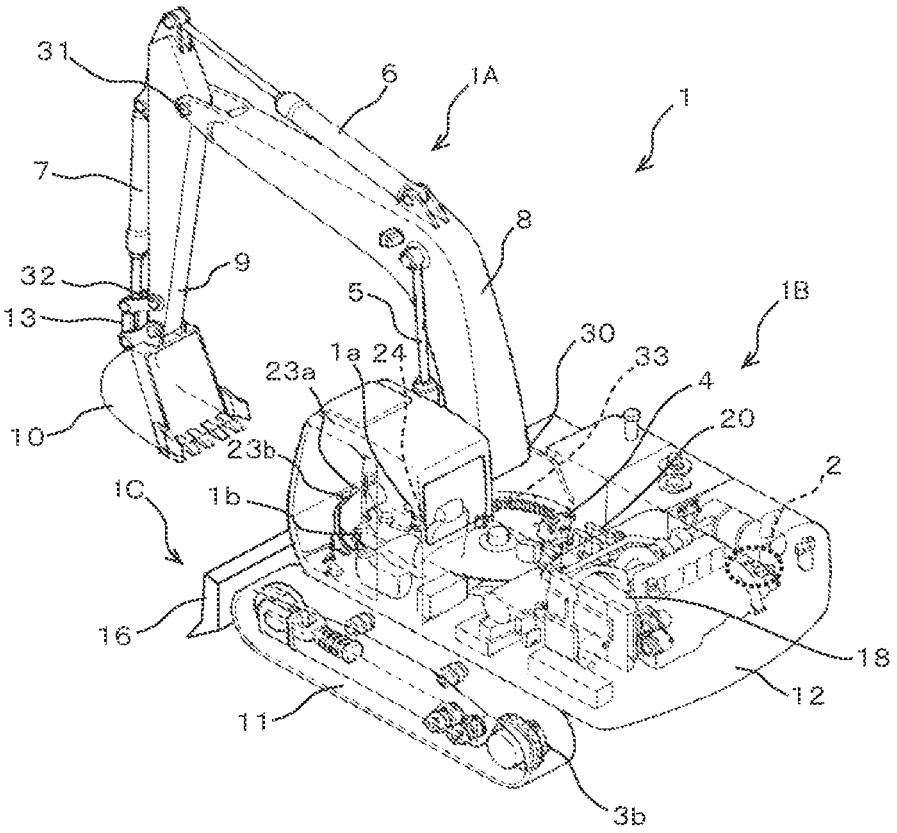
FIG. 1 is a structure diagram of a hydraulic excavator according to Embodiment 1 of the present invention.

Embodiments of the present invention will be described hereinafter with reference to the drawings. It is noted that a hydraulic excavator provided with a front work device and a blade work device is exemplarily illustrated as a work device for changing a target work object from a certain state to the other state, and that the target work object is assumed as a target surface formed by excavation and ground leveling work. The target work object that is a work object of a work device may be common to work devices or may be set per work device. Furthermore, while a hydraulic excavator provided with a bucket 10 as an attachment on a tip end of the front work device is exemplarily illustrated, the present invention may be applied to a hydraulic excavator provided with an attachment other than the bucket. Moreover, the present invention is applicable to a work machine other than the hydraulic excavator as long as the work machine has a plurality of work devices.

Furthermore, as for meanings of "on," "above," and "below" used together with a term indicating a certain shape (for example, a target surface or a surface to be controlled), it is assumed in the present paper that "on" means a "surface" of the certain shape, "above" means a "position higher than the surface" of the certain shape, and "below" means a "position lower than the surface" of the certain shape. In the following description, in a case in which a plurality of same constituent elements are present, alphabets are often added to tail ends of reference characters (numbers). However, the plurality of constituent elements are often denoted generically by omitting the alphabets. For example, when three pumps 300*a*, 300*b*, and 300*c* are present, these are often denoted generically by pumps 300.

Basic Structure

Figure 2:
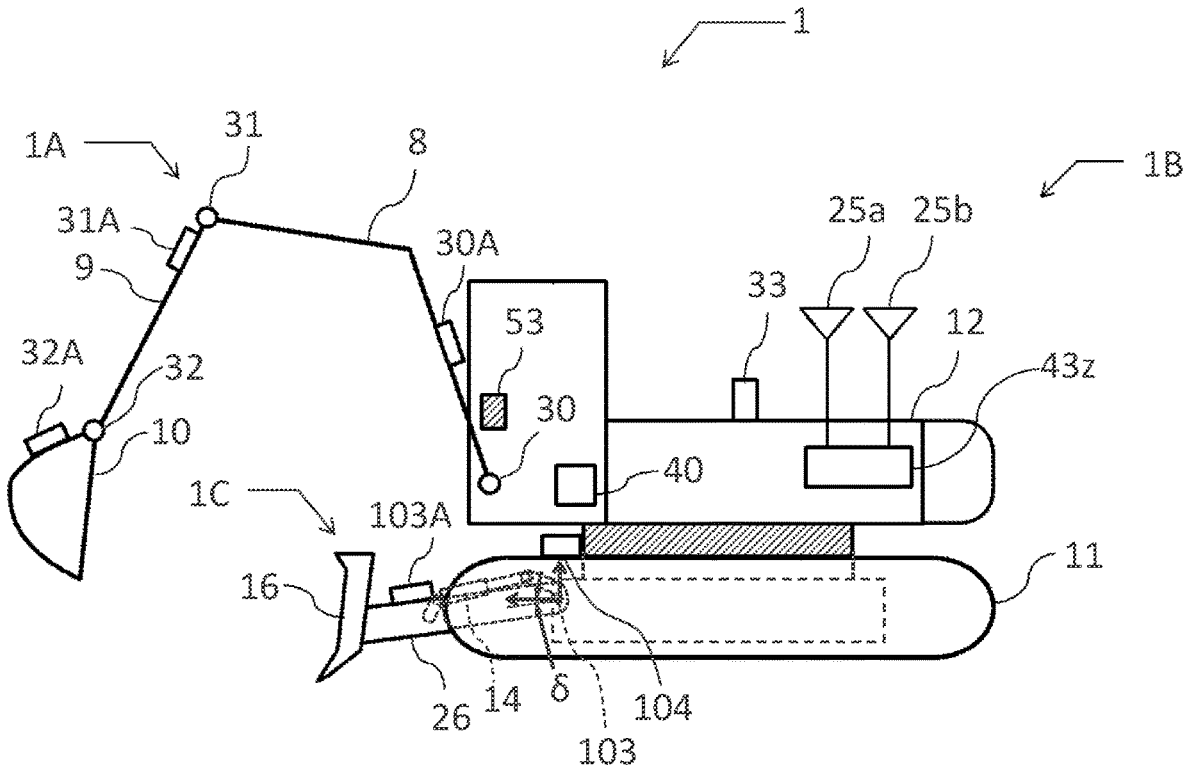
FIG. 2 is a schematic diagram of the hydraulic excavator of FIG. 1.
Figure 3:
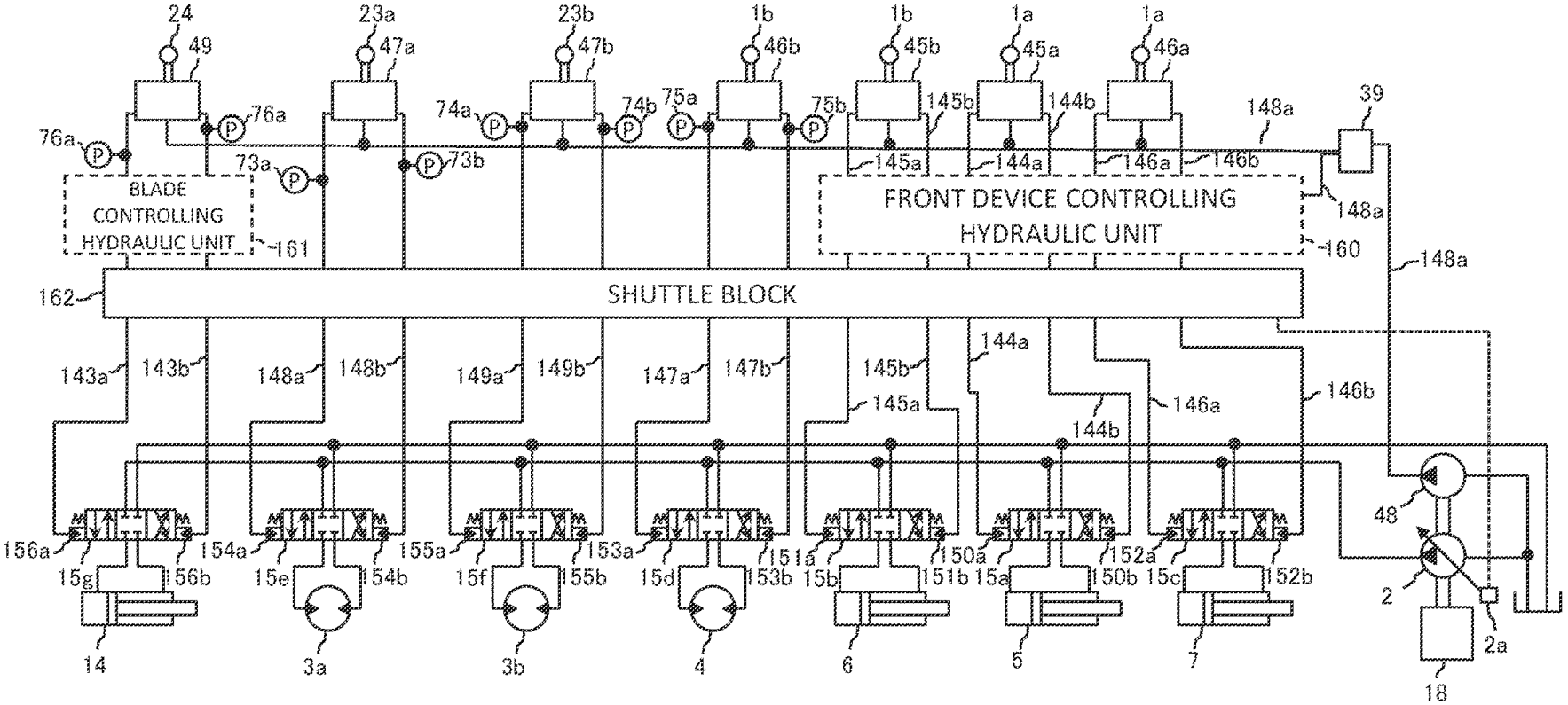
FIG. 3 is a diagram depicting a controller of the hydraulic excavator along with a hydraulic drive system.
Figure 4:
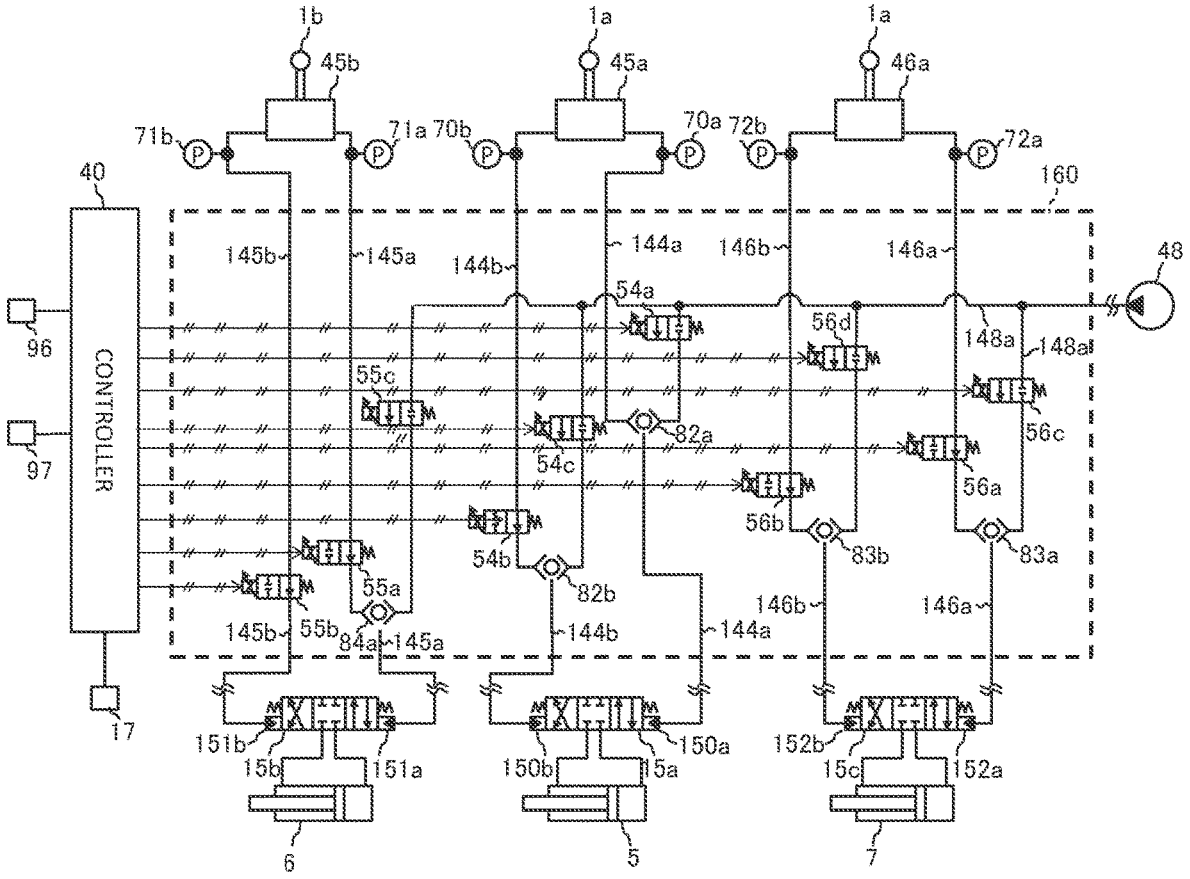
FIG. 4 is a detailed diagram of a front device controlling hydraulic unit of the hydraulic excavator.
Figure 5:
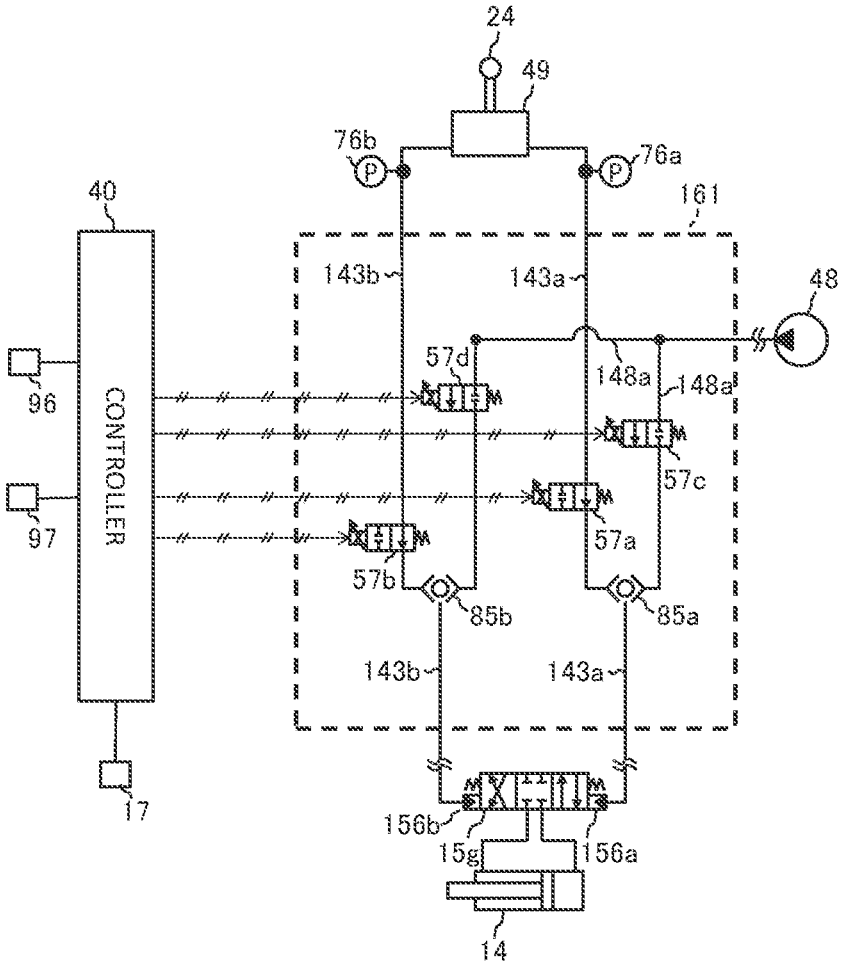
FIG. 5 is a detailed diagram of a blade controlling hydraulic unit of the hydraulic excavator.

FIG. 1 is a structure diagram of a hydraulic excavator according to Embodiment 1, FIG. 2 is a schematic diagram of the hydraulic excavator of FIG. 1, FIG. 3 is a diagram depicting a controller of the hydraulic excavator according to Embodiment 1 along with a hydraulic drive system, FIG. 4 is a detailed diagram of a front device controlling hydraulic unit 160 in FIG. 3, and FIG. 5 is a detailed diagram of a blade controlling hydraulic unit 161 in FIG. 3.

In FIGS. 1 and 2, a hydraulic excavator 1 is structured with a multijoint type front work device 1A, a machine body 1B, and a blade work device 1C. The machine body 1B is structured with a lower travel structure 11 that travels by left and right travel hydraulic motors 3*a* and 3*b*, and an upper swing structure 12 that is attached onto the lower travel structure 11 and swings by a swing hydraulic motor 4.

The front work device 1A is structured by coupling a plurality of driven members (a boom 8, an arm 9, and a bucket 10) each rotating in a perpendicular direction. A base end of the boom 8 is rotatably supported by a front portion of the upper swing structure 12 via a boom pin. The arm 9 is rotatably coupled to a tip end of the boom 8 via an arm pin and the bucket 10 is rotatably coupled to a tip end of the arm 9 via a bucket pin. The boom 8 is driven by a boom cylinder 5, the arm 9 is driven by an arm cylinder 6, and the bucket 10 is driven by a bucket cylinder 7.

A boom angle sensor 30, an arm angle sensor 31, and a bucket angle sensor 32 are attached to the boom pin, the arm pin, and a bucket link 13 so as to be able to measure rotation angles α, β, and γ (refer to FIG. 7) of the boom 8, the arm 9, and the bucket 10, respectively, and a machine body tilting angle sensor 33 that detects a tilting angle θ (refer to FIG. 7) of the upper swing structure 12 (machine body 1B) with respect to a reference plane (for example, horizontal plane) is attached to the upper swing structure 12. It is noted that the angle sensors 30, 31, and 32 can be replaced by angle sensors 30A, 31A, and 32A (refer to FIG. 2) that measure rotation angles with respect to the reference plane (for example, horizontal plane), respectively.

As depicted in FIG. 2, the blade work device 1C is provided with a dozer arm 26 having a base end rotatably attached to a front side of the lower travel structure 11 by an arm spindle, a blade 16 provided on a tip end of the dozer arm 26, and a dozer cylinder 14 looped over the dozer arm 26 and the lower travel structure 11. The blade 16 moves downward in response to an expansion of the cylinder 14 and moves upward in response to a contraction of the cylinder 14. A dozer arm angle sensor 103 that detects a rotation angle of the dozer arm 26 is attached to the arm spindle, and a swing angle sensor 104 that detects a relative swing angle of the lower travel structure 11 with respect to the upper swing structure 12 is attached to the lower travel structure 11. It is noted that the angle sensor 103 can be replaced by an angle sensor 103A (refer to FIG. 2) that measures a rotation angle with respect to the reference plane (for example, horizontal plane). Furthermore, as for the swing angle sensor 104, the hydraulic excavator 1 may be structured such that a relative swing angle of the upper swing structure 12 or the lower travel structure 11 relative to each other can be detected, and the excavator may be structured, for example, such that the swing angle sensor 104 is attached to the upper swing structure 12 and that the relative swing angle of the upper swing structure 12 with respect to the lower travel structure 11 can be detected.

Within a cabin provided in the upper swing structure 12, an operation device 47*a* (FIG. 3) having a travel right lever 23*a* (FIG. 1) and operating the travel right hydraulic motor 3*a* (lower travel structure 11), an operation device 47*b* (FIG. 3) having a travel left lever 23*b* (FIG. 1) and operating the travel left hydraulic motor 3*b* (lower travel structure 11), operation devices 45*a* and 46*a* (FIG. 3) commonly having an operation right lever 1*a* (FIG. 1) and operating the boom cylinder 5 (boom 8) and the bucket cylinder 7 (bucket 10), an operation devices 45*b* and 46*b* (FIG. 3) commonly having an operation left lever 1*b* (FIG. 1) and operating the arm cylinder 6 (arm 9) and the swing hydraulic motor 4 (upper swing structure 12), and an operation device 49 (FIG. 3) having a blade operation lever 24 and operating the dozer cylinder 14 (blade 16) are installed. The travel right lever 23*a*, the travel left lever 23*b*, the operation right lever 1*a*, the operation left lever 1*b*, and the blade operation lever 24 are often generically referred to as "operation levers 1, 23, and 24."

An engine 18 that is mounted in the upper swing structure 12 and that is a prime mover drives a hydraulic pump 2 and a pilot pump 48. The hydraulic pump 2 is a variable displacement hydraulic pump at a capacity controlled by a regulator 2*a*, while the pilot pump 48 is a fixed displacement hydraulic pump. As depicted in FIG. 3, in Embodiment 1, a shuttle block 162 is provided halfway along pilot lines 143, 144, 145, 146, 147, 148, and 149. Hydraulic signals output from the operation devices 45, 46, 47, and 49 are also input to the regulator 2*a* via this shuttle block 162. While a detailed structure of the shuttle block 162 is omitted, the hydraulic signals are input to the regulator 2*a* via the shuttle block 162, and a delivery flow rate of the hydraulic pump 2 is controlled in response to the hydraulic signals.

A pump line 148*a* that is a delivery pipe of the pilot pump 48 is branched off into a plurality of lines after passing through a lock valve 39, and the branch lines are connected to valves of the operation devices 45, 46, 47, and 49, the front device controlling hydraulic unit 160, and the blade controlling hydraulic unit 161. The lock valve 39 is a solenoid selector valve in Embodiment 1, and a solenoid driving section of the lock valve 39 is electrically connected to a position sensor of a gate lock lever (not depicted) disposed within the cabin (FIG. 1). A position of the gate lock lever is detected by the position sensor, and a signal in response to the position of the gate lock lever is input from the position sensor to the lock valve 39. The lock valve 39 is closed to interrupt the pump line 148*a* when the position of the gate lock lever is a lock position, and is opened to open the pump line 148*a* when the position thereof is an unlock position. In other words, in a state of interrupting the pump line 148*a*, operations by the operation devices 45, 46, 47, and 49 are made invalid to prohibit actions such as swing, excavation, and blade height adjustment.

The operation devices 45, 46, 47, and 49 are hydraulic pilot type operation devices, and generate pilot pressures (often referred to as "operating pressures") in response to operation amounts (for example, lever strokes) and operation directions of the operation levers 1, 23, and 24 operated by an operator on the basis of a pressurized fluid delivered from the pilot pump 48. The pilot pressures generated in this way are supplied to hydraulic drive sections 150*a* to 156*b* of corresponding flow control valves 15*a* to 15*g* (refer to FIG. 3) within a control valve unit 20 via the pilot lines 143*a* to 149*b* (refer to FIG. 3) and used as control signals for driving these flow control valves 15*a* to 15*g*.

A pressurized fluid delivered from the hydraulic pump 2 is supplied to the travel right hydraulic motor 3*a*, the travel left hydraulic motor 3*b*, the swing hydraulic motor 4, the boom cylinder 5, the arm cylinder 6, the bucket cylinder 7, and the dozer cylinder 14 via the flow control valves 15*a*, 15*b*, 15*c*, 15*d*, 15*e*, 15*f*, and 15*g* (refer to FIG. 3). The boom cylinder 5, the arm cylinder 6, and the bucket cylinder 7 expand and contract by the supplied pressurized fluid, whereby the boom 8, the arm 9, and the bucket 10 rotate and a position and a posture of the bucket 10 change. Furthermore, the swing hydraulic motor 4 rotates by the supplied pressurized fluid, whereby the upper swing structure 12 swings with respect to the lower travel structure 11. Moreover, the travel right hydraulic motor 3*a* and the travel left hydraulic motor 3*b* rotate by the supplied pressurized fluid, whereby the lower travel structure 11 travels. Further, the dozer cylinder 14 expands and contracts by the supplied pressurized fluid, whereby a height of the blade 16 changes.

Figure 6:
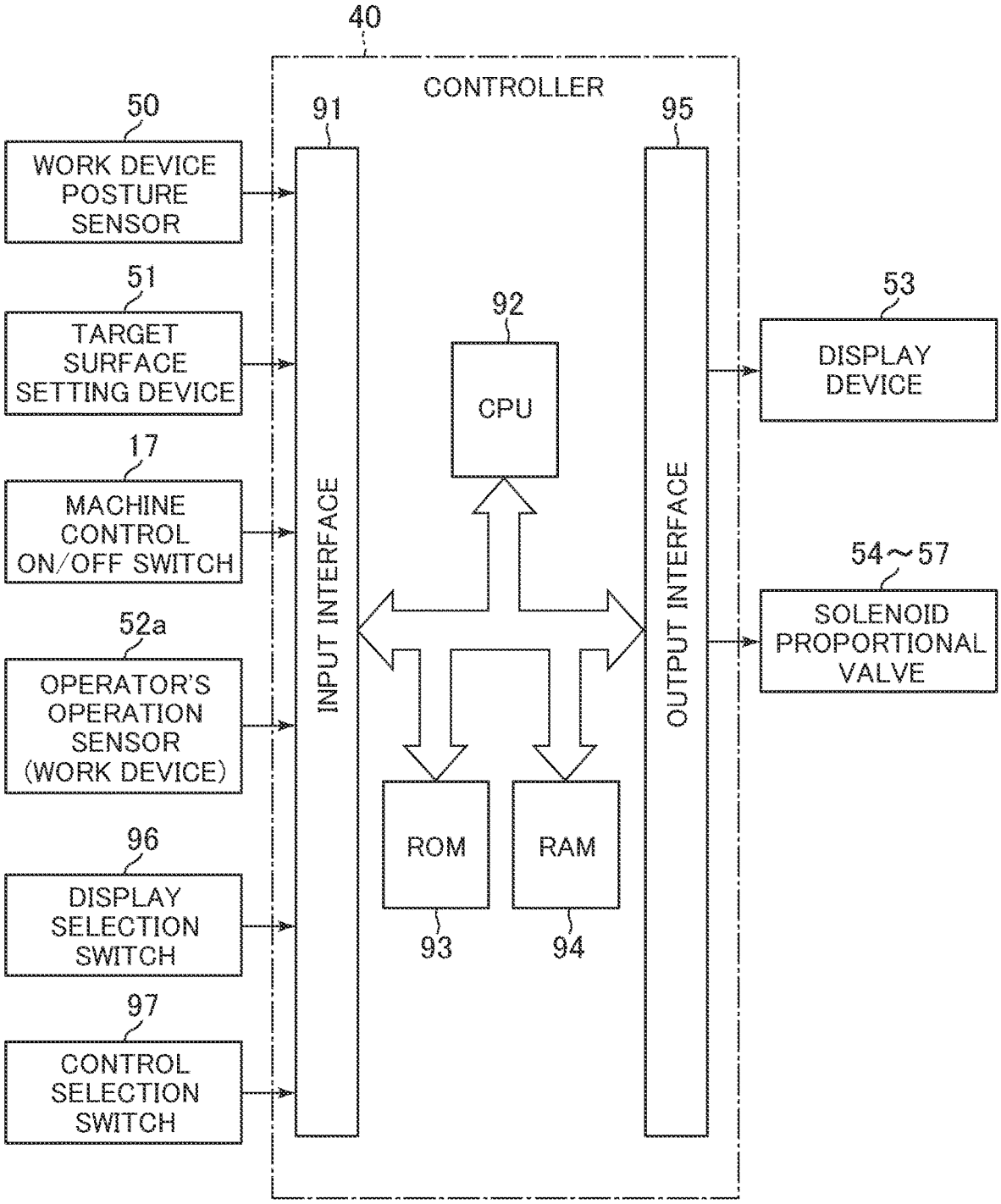
FIG. 6 is a hardware structure diagram of the controller of the hydraulic excavator.

FIG. 6 is a structure diagram of a machine guidance (MG)/machine control (MC) system provided in the hydraulic excavator according to Embodiment 1. The system of FIG. 6 executes, as the MG, a process for displaying a position relationship between each of the work devices 1A and 1C and a target surface 60 (refer to FIG. 7) on a display device 53. In addition, when the operator operates the operation devices 45, 46, and 49, the system of FIG. 6 executes, as the MC, a process for controlling the front work device 1A and the blade work device 1C on the basis of a preset condition. In the present paper, the machine control (MC) is often referred to as "semiautomatic control" to control actions of the work devices 1A and 1C by a computer only when the operation devices 45, 46, and 49 are operated, as opposed to "automatic control" to control the actions of the work devices 1A and 1C when the operation devices 45, 46, and 49 are not operated. Details of MC controlling according to Embodiment 1 will next be described.

As the MC controlling over the front work device 1A, in a case in which an excavation operation (specifically, an instruction to perform at least one of arm crowding, bucket crowding, and bucket dumping) is input via the operation device 45*b* or 46*a*, the MG/MC system outputs, to the relevant flow control valve 15*a*, 15*b*, or 15*c*, a control signal to forcibly actuate at least one of the hydraulic actuators 5, 6, and 7 (for example, to expand the boom cylinder 5 to force the boom cylinder 5 to perform a boom raising action) so that a position of a tip end (assumed as a claw tip of the bucket 10 in Embodiment 1) of the work device 1A can be kept in an area on and above the target surface 60 (refer to FIG. 7) on the basis of a position relationship between the target surface 60 and the tip end of the work device 1A.

As the MC controlling over the blade work device 1C, in a case in which an operation of height adjustment of the blade 16 is input via the operation device 49, the MC/MG system outputs, to the flow control valve 15*g*, a control signal to forcibly actuate the hydraulic actuator (dozer cylinder) 14 (for example, to expand the dozer cylinder 14 to force the dozer cylinder 14 to perform an action of lowering the blade 16) so that a position of a lower end of the blade 16 can be kept in the area on and above the target surface 60 on the basis of a position relationship between the target surface 60 and the lower end of the blade 16. In the present paper, the MC controlling related to the front work device 1A and the blade work device 1C is often referred to as "area limiting control."

Since these series of the MC controlling prevent the claw tip of the bucket 10 and the lower end of the blade 16 from entering an area below the target surface 60, it is possible to perform excavation and ground leveling along the target surface 60 regardless of a degree of operator's skill. A control point of the front work device 1A at the time of the MC is set to the claw tip of the bucket 10 of the hydraulic excavator (tip end of the work device 1A) in Embodiment 1; however, the control point can be changed to a point other than the bucket claw tip as long as the point is present in a tip end portion of the work device 1A. For example, a bottom surface of the bucket 10 or an outermost portion of the bucket link 13 can be selected as the control point. Likewise, a control point (blade lower end) of the blade work device 1C can be changed to a point other than the blade lower end as appropriate as long as the point is on the work device 1C.

The system of FIG. 6 is provided with a work device posture sensor 50, a target surface setting device 51, an operator's operation sensor 52*a*, the display device (for example, liquid crystal display) 53 that is installed in the cabin and that can display the position relationship between the target surface 60 and each of the work devices 1A and 1C, a machine control ON/OFF switch 17 that is provided on the operation lever 1*a* and that alternatively changes over between valid and invalid for the machine control, two satellite communication antennas 25*a* and 25*b* of a GNSS receiver or the like installed on the upper swing structure 12, a display selection switch 96 for selecting one work device for which the position relationship between the work device and the target surface 60 is displayed on the display device 53 from between the two work devices 1A and 1C, a control selection switch 97 for selecting one work device over which the MC controlling is executed from between the two work devices 1A and 1C, and a controller 40 that is a computer in charge of the MG controlling and the MC controlling.

The work device posture sensor 50 is structured with the boom angle sensor 30, the arm angle sensor 31, the bucket angle sensor 32, the machine body tilting angle sensor 33, the dozer arm angle sensor 103, and the swing angle sensor 104. These angle sensors 30, 31, 32, 33, 10, and 104 function as posture sensors for the work device 1A or 1C.

The target surface setting device 51 is an interface to which information about the target angle 60 (containing position information about each target surface and tilting angle information) can be input. The target surface setting device 51 is connected to an external terminal (not depicted) that stores three-dimensional data regarding the target surface specified on a global coordinate system (absolute coordinate system). It is noted that the operator may manually input the target surface via the target surface setting device 51.

The operator's operation sensor 52*a* is structured with pressure sensors 70*a*, 70*b*, 71*a*, 71*b*, 72*a*, 72*b*, 76*a*, and 76*b* that acquire operating pressures (first control signals) generated in the pilot lines 143, 144, 145, and 146 by operator's operating the operation levers 1*a* and 1*b* (operation devices 45*a*, 45*b*, and 46*a*) and the operation lever 24 (operation device 49). In other words, the operator's operation sensor 52*a* detects operations on the hydraulic cylinders 5, 6, and 7 related to the work device 1A and an operation on the hydraulic cylinder 14 related to the work device 1C.

The machine control ON/OFF switch 17 is provided in an upper end portion of a front surface of the operation lever 1*a* of a joystick shape and depressed by, for example, a thumb of the operator gripping the operation lever 1*a*. The machine control ON/OFF switch 17 is a momentary switch and changes over between valid and invalid for the machine control whenever the machine control ON/OFF switch 17 is depressed. It is noted that an installation location of the switch 17 is not limited to the operation lever 1*a* (1*b*) but may be another location.

The display selection switch 96 is a device for the operator to select one work device to be displayed on the display device 53 from between the plurality of work devices 1A and 1C, and outputs a signal (first input signal) for displaying the operator's selected work device on the display device 53 to a display changeover section 81*c*. Specifically, the display selection switch 96 is structured to be able to select a changeover position from among those for a first pattern for displaying the front work device 1A, a second pattern for displaying the blade work device 1C, and a third pattern for displaying both of the two work devices 1A and 1C as a pattern for displaying any of the work devices on the display device 53, and outputs the first input signal varying depending on the changeover position.

The control selection switch 97 is a device for the operator to select one work device for which the MC is made valid from between the plurality of work devices 1A and 1C, and outputs a signal (second input signal) for making valid the MC over the operator's selected work device to a control changeover section 81*f*. Specifically, the control selection switch 97 is structured to be able to select one changeover position from among those for a first pattern for executing the MC over the front work device 1A but not executing the MC over the blade work device 1C, a second pattern for executing the MC over the blade work device 1C but not executing the MC over the front work device 1A, and a third pattern for executing the MC over both of the front work device 1A and the blade work device 1C as a pattern for making the MC valid, and outputs the second input signal varying depending on the changeover position.

It is noted that the switches 96 and 97 are not necessarily structured as hardware but may be structured by a graphical user interface (GUI) displayed on a display screen of the display device 53 upon making the display device 53 into, for example, a touch panel.

Front Device Controlling Hydraulic Unit 160

As depicted in FIG. 4, the front device controlling hydraulic unit 160 is structured with the pressure sensors 70*a* and 70*b* (refer to FIG. 4) that are provided in the pilot lines 144*a* and 144*b* of the operation device 45*a* for the boom 8 and that detect pilot pressures (first control signals) as operation amounts of the operation lever 1*a*, a solenoid proportional valve 54*a* (refer to FIG. 4) that has a primary port side connected to the pilot pump 48 via the pump line 148*a* and that reduces the pilot pressure from the pilot pump 48 to output the reduced pilot pressure, a shuttle valve 82*a* (refer to FIG. 4) that is connected to the pilot line 144*a* of the operation device 45*a* for the boom 8 and a secondary port side of the solenoid proportional valve 54*a*, that selects a higher pressure out of the pilot pressure in the pilot line 144*a* and a control pressure (second control signal) output from the solenoid proportional valve 54*a*, and that introduces the selected pressure to the hydraulic drive section 150*a* of the flow control valve 15*a*, a solenoid proportional valve 54*b* (refer to FIG. 4) that is installed in the pilot line 144*b* of the operation device 45*a* for the boom 8 and that reduces the pilot pressure (first control signal) in the pilot line 144*b* on the basis of a control signal from the controller 40 to output the reduced pilot pressure, a solenoid proportional valve 54*c* (refer to FIG. 4) that has a primary port side connected to the pilot pump 48 and that reduces the pilot pressure from the pilot pump 48 to output the reduced pilot pressure, and a shuttle valve 82*b* (refer to FIG. 4) that selects a higher pressure out of the pilot pressure in the pilot line 144*b* and a control pressure output from the solenoid proportional valve 54*c* and that introduces the selected pressure to the hydraulic drive section 150*b* of the flow control valve 15*a*.

Furthermore, the front device controlling hydraulic unit 160 is provided with the pressure sensors 71*a* and 71*b* (refer to FIG. 4) that are installed in the pilot lines 145*a* and 145*b* for the arm 9 and that detect pilot pressures (first control signals) as operation amounts of the operation lever 1*b* to output the pilot pressures (first control signals) to the controller 40, a solenoid proportional valve 55*b* (refer to FIG. 4) that is installed in the pilot line 145*b* and that reduces the pilot pressure (first control signal) on the basis of a control signal from the controller 40 to output the reduced pilot pressure (first control signal), a solenoid proportional valve 55*a* (refer to FIG. 4) that is installed in the pilot line 145*a* and that reduces the pilot pressure (first control signal) in the pilot line 145*a* on the basis of a control signal from the controller 40 to output the reduced pilot pressure (first control signal), a solenoid proportional valve 55*c* (refer to FIG. 4) that has a primary port side connected to the pilot pump 48 and that reduces the pilot pressure from the pilot pump 48 to output the reduced pilot pressure, and a shuttle valve 84*a* (refer to FIG. 4) that selects a higher pressure out of the pilot pressure in the pilot line 145*a* and a control pressure output from the solenoid proportional valve 55*c* and that introduces the selected pressure to the hydraulic drive section 151*a* of the flow control valve 15*b*.

Moreover, the front device controlling hydraulic unit 160 is provided with, in pilot lines 146*a* and 146*b* for the bucket 10, pressure sensors 72*a* and 72*b* (refer to FIG. 4) that detect pilot pressures (first control signals) as operation amounts of the operation lever 1*a* and that output the detected pilot pressures to the controller 40, solenoid proportional valves 56*a* and 56*b* (refer to FIG. 4) that reduce the pilot pressures (first control signals) on the basis of a control signal from the controller 40 to output the reduced pilot pressures (first control signals), solenoid proportional valves 56*c* and 56*d* (refer to FIG. 4) that have primary port sides connected to the pilot pump 48 and that reduce the pilot pressure from the pilot pump 48 to output the reduced pilot pressure, and shuttle valves 83*a* and 83*b* (refer to FIG. 4) each of which selects a higher pressure out of the pilot pressure in the pilot line 146*a* or 146*b* and a control pressure output from the solenoid proportional valve 56*c* or 56*d* and each of which introduces the selected pressure to the hydraulic drive section 152*a* or 152*b* of the flow control valve 15*c*. It is noted that connection lines between the pressure sensors 70, 71, and 72 and the controller 40 are not depicted in FIG. 4 because of space limitations.

Blade Controlling Hydraulic Unit 161

As depicted in FIG. 5, in the blade controlling hydraulic unit 161, the pressure sensors 76*a* and 76*b* that detect pilot pressures (first control signals) as operation amounts of the operation lever 24 and that output the detected pilot pressures (first control signals) to the controller 40, solenoid proportional valves 57*a* and 57*b* that reduce the pilot pressures (first control signals) on the basis of a control signal from the controller 40 to output the reduced pilot pressures, solenoid proportional valves 57*c* and 57*d* that have primary port sides connected to the pilot pump 48 and that reduce the pilot pressure from the pilot pump 48 to output the reduced pilot pressure, and shuttle valves 85*a* and 85*b* each of which selects a high pressure out of the pilot pressure in the pilot line 143*a* or 143*b* and a control pressure output from the solenoid proportional valve 57*c* or 57*d* and each of which introduces the selected pressure to the hydraulic drive section 156*a* or 156*b* of the flow control valve 15*g* are provided in the pilot lines 143*a* and 143*b* for the blade 16 (dozer cylinder 14). It is noted that a connection line between the pressure sensor 76 and the controller 40 is not depicted in FIG. 5 because of space limitations.

Opening degrees of the solenoid proportional valves 54*b*, 55*a*, 55*b*, 56*a*, 56*b*, 57*a*, and 57*b* are maximum when currents are not carried, and become smaller as the currents that are the control signals from the controller 40 are increased. On the other hand, opening degrees of the solenoid proportional valves 54*a*, 54*b*, 55*c*, 56*c*, 56*d*, 57*c* and 57*d* are zero when currents are not carried, are not zero when currents are carried, and become larger as the currents (control signals) from the controller 40 are increased. In this way, the opening degrees 54, 55, 56, and 57 of the solenoid proportional valves are in response to the control signals from the controller 40.

In the controlling hydraulic units 160 and 161 structured as described above, when the controller 40 outputs the control signals to drive the solenoid proportional valves 54*a*, 54*c*, 55*c*, 56*c*, 56*d*, 56*c*, and 56*d*, pilot pressures (second control signals) can be generated even without operator's operating the corresponding operation devices 45*a*, 46*a*, and 49; thus, it is possible to forcibly generate a boom raising action, a boom lowering action, an arm crowding action, a bucket crowding action, a bucket dumping action, a blade raising action, or a blade lowering action. Likewise, when the controller 40 drives the solenoid proportional valves 54*b*, 55*a*, 55*b*, 56*a*, 56*b*, 57*a*, and 57*b*, pilot pressures (second control signals) can be generated by reducing the pilot pressures (first control signals) generated by operator's operating the operation devices 45*a*, 45*b*, 46*a*, and 49; thus, it is possible to forcibly reduce a speed of the boom lowering action, the arm crowding/dumping action, the bucket crowding/dumping action, or the blade raising/lowering action from an operator's operation value.

In the present paper, the pilot pressures generated by operating the operation devices 45*a*, 45*b*, 46*a*, and 49 will be referred to as "first control signals" among the control signals for the flow control valves 15*a* to 15*c* and 15*g*. In addition, among the control signals for the flow control valves 15*a* to 15*c* and 15*g*, the pilot pressures generated by correcting (reducing) the first control signals by causing the controller 40 to drive the solenoid proportional valves 54*b*, 55*a*, 55*b*, 56*a*, 56*b*, 57*a*, and 57*b*, and the pilot pressures newly generated independently of the first control signals by causing the controller 40 to drive the solenoid proportional valves 54*a*, 54*c*, 55*c*, 56*c*, 56*d*, 57*c*, and 57*d* will be referred to as "second control signals."

While details of the second control signals will be described later, the second control signals are generated when a speed vector of the control point of the work device 1A or 1C generated by the first control signals is against a predetermined limitation, and generated as control signals for generating a speed vector of the control point of the work device 1A or 1C that is not against the predetermined limitation. In a case in which the first control signal is generated for one of the hydraulic drive sections of any of the flow control valves 15*a* to 15*c* and 15*g* and the second control signal is generated for the other hydraulic drive section, it is assumed that the second control signal is allowed to preferentially act on the hydraulic drive section, the first control signal is interrupted by the solenoid proportional valve, and the second control signal is input to the other hydraulic drive section. Therefore, each of some of the flow control valves 15*a* to 15*c* and 15*g* for which the second control signals are computed is controlled on the basis of the second control signal, each of those for which the second control signals are not computed is controlled on the basis of the first control signal, and each of those for which neither the first control signals nor the second control signals are not generated is not controlled (driven). In a case of defining the first control signals and the second control signals as described above, it can be said that the MC is control over the flow control valves 15*a* to 15*c* and 15*g* on the basis of the second control signals.

Controller 40

In FIG. 6, the controller 40 has an input section 91, a central control unit (CPU) 92 that is a processor, a read only memory (ROM) 93 and a random access memory (RAM) 94 that are storage devices, and an output section 95. Signals from the angle sensors 30 to 32, 103, and 104 and the tilting angle sensor 33 that structure the work device posture sensor 50, a signal from the target surface setting device 51 that is a device for setting the target surface 60, a signal from the machine control ON/OFF switch 17, signals from the operator's operation sensor 52*a* that is the pressure sensor (including the pressure sensors 70, 71, and 72) detecting operation amounts from the operation devices 45*a*, 45*b*, and 46*a*, and signals from the selection switches 96 and 97 are input to the input section 91, and the input section 91 converts the signals in such a manner that the CPU 92 can perform computation. The ROM 93 is a recording medium that stores a control program for executing MG/MC including a process related to a flowchart to be described later, various information necessary to execute the flowchart, and the like, and the CPU 92 performs predetermined computing processes on the signals imported from the input section 91 and the memories 93 and 94 in accordance with the control program stored in the ROM 93. The output section 95 creates signals to be output in response to computation results of the CPU 92 and outputs the signals to the solenoid proportional valves 54 to 57 or to the display device 53, thereby driving/controlling the hydraulic actuators 5 to 7 and 14 or displaying images of the machine body 1B, the bucket 10, the blade 16, the target surface 60, and the like on a screen of the display device 53.

While the controller 40 of FIG. 6 is provided with the ROM 93 and the RAM 94 that are semiconductor memories as the storage devices, the semiconductor memories can be replaced by other devices as long as the devices are storage devices. For example, the controller 40 may be provided with a magnetic storage device such as a hard disk drive.

Figure 8:
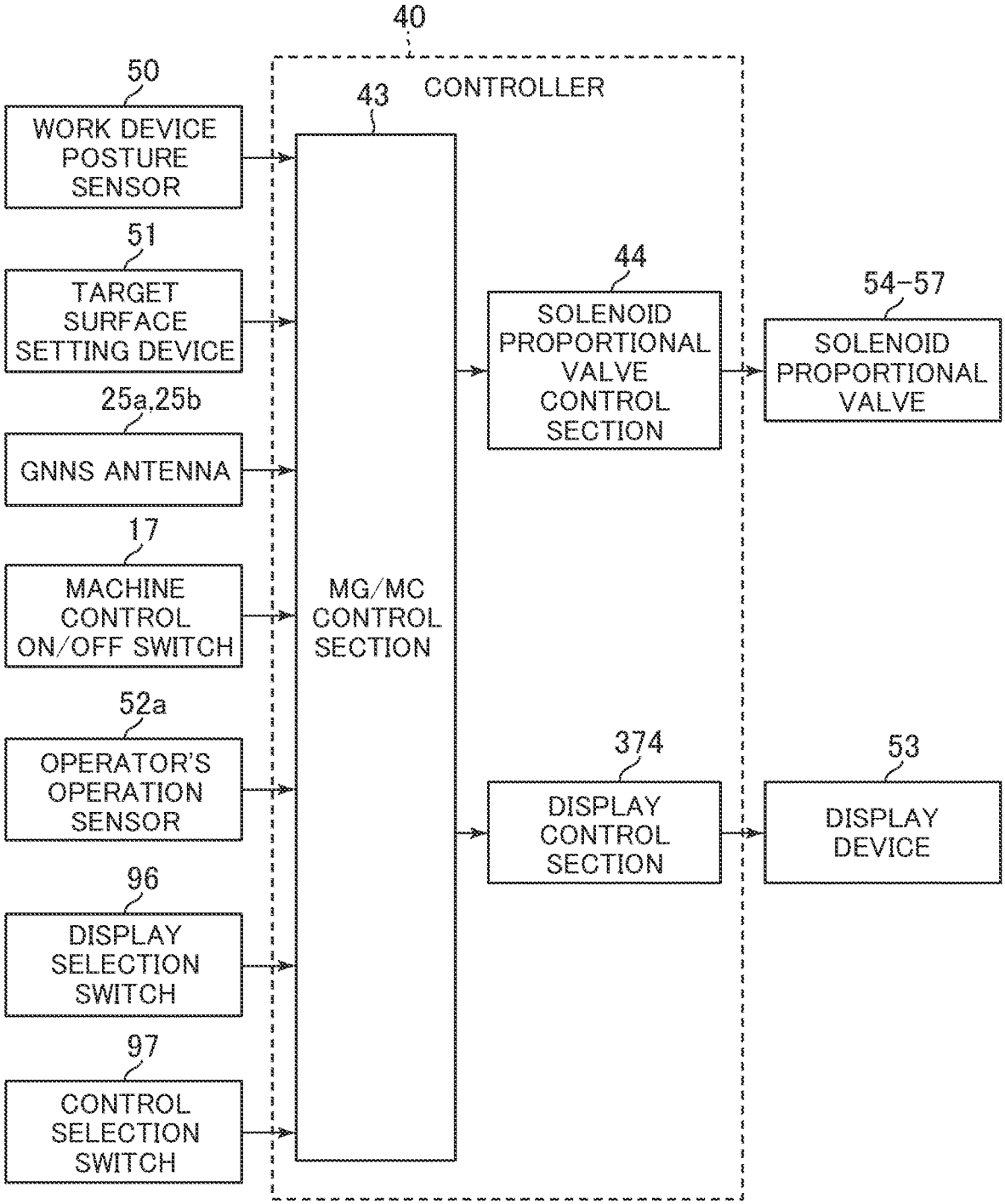
FIG. 8 is a functional block diagram of the controller of the hydraulic excavator.

FIG. 8 is a functional block diagram of the controller 40 according to Embodiment 1 of the present invention. The controller 40 is provided with an MG/MC control section 43, a solenoid proportional valve control section 44, and a display control section 374.

Display Control Section 374

The display control section 374 is a part that controls the display device 53 on the basis of postures of the work devices output from the MG/MG/MC control section 43, the target surface, a machine control ON/OFF state, and a work machine selection state by the switch 96. The display control section 374 is provided with a display ROM that stores lots of display-associated data containing images and icons of the work devices 1A and 1C, and the display control section 374 reads a predetermined program on the basis of a flag contained in input information and executes display control over the display device 53. A specific example of a display screen will be described later.

MG/MC Control Section 43 and Solenoid Proportional Valve Control Section 44

Figure 9:
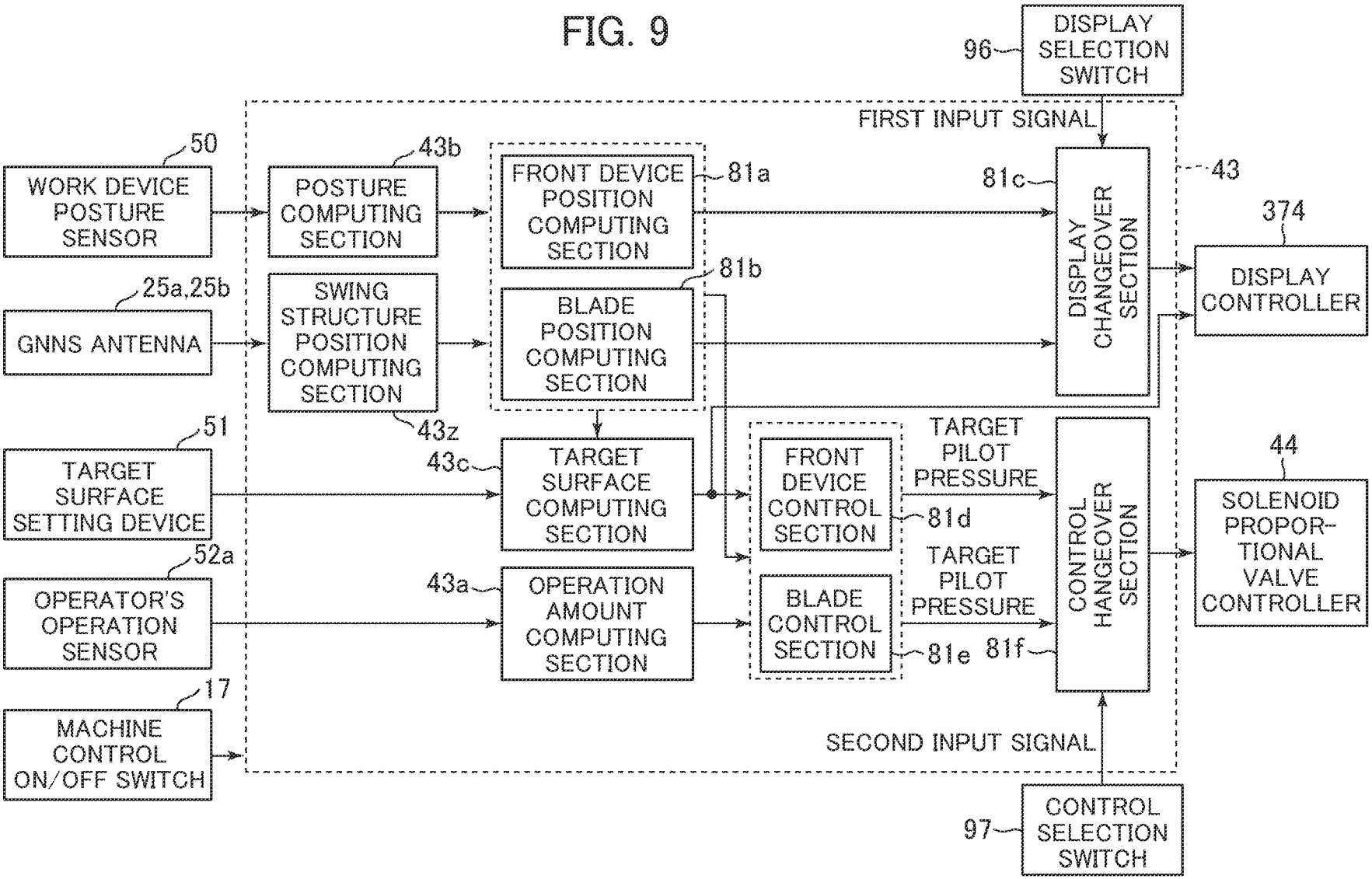
FIG. 9 is a functional block diagram of an MG/MC controller in FIG. 8.

FIG. 9 is a functional block diagram of the MG/MC control section 43 depicted in FIG. 8. The MG/MC control section 43 is provided with an operation amount computing section 43*a*, a posture computing section 43*b*, a target surface computing section 43*c*, a swing structure position computing section 43*z*, a front device position computing section 81*a*, a blade position computing section 81*b*, a display changeover section 81*c*, a front device control section 81*d*, a blade control section 81*e*, and a control changeover section 81*f*.

The operation amount computing section 43*a* calculates the operation amounts of the operation devices 45*a*, 45*b*, 46*a*, and 49 (operation levers 1*a*, 1*b*, and 24) on the basis of inputs from the operator's operation sensor 52*a*. The operation amount computing section 43*a* can calculate the operation amounts of the operation devices 45*a*, 45*b*, 46*a*, and 49 detection values of the pressure sensors 70, 71, 72, and 76.

It is noted that the calculation of the operation amounts by the pressure sensors 70, 71, 72, and 76 is an example only and that operation amounts of the operation levers of the operation devices 45*a*, 45*b*, 46*a*, and 49 may be detected by, for example, position sensors (for example, rotary encoders) calculating rotation displacements of the operation levers thereof. Furthermore, as an alternative to the structure of calculating action speeds from the operation amounts, a structure such that stroke sensors that detect expansion/contraction amounts of the hydraulic cylinders 5, 6, 7, and 14 are attached and the action speeds of the cylinders are calculated on the basis of changes in the detected expansion/contraction amounts over time is also applicable.

The swing structure position computing section 43*z* acquires position information about the upper swing structure 12 in the global coordinate system from outputs from the satellite communication antennas 25*a* and 25*b* by RTK-GPS (Real Time Kinematic Global Positioning System) measurement. At this time, the satellite communication antennas 25*a* and 25*b* function as position sensors for the upper swing structure 12.

The posture computing section 43*b* computes the posture of the front work device 1A, the position of the claw tip of the bucket 10, the posture of the blade work device 1C, and the position of the lower end of the blade 16 in a local coordinate system on the basis of information from the work device posture sensor 50.

Figure 7:
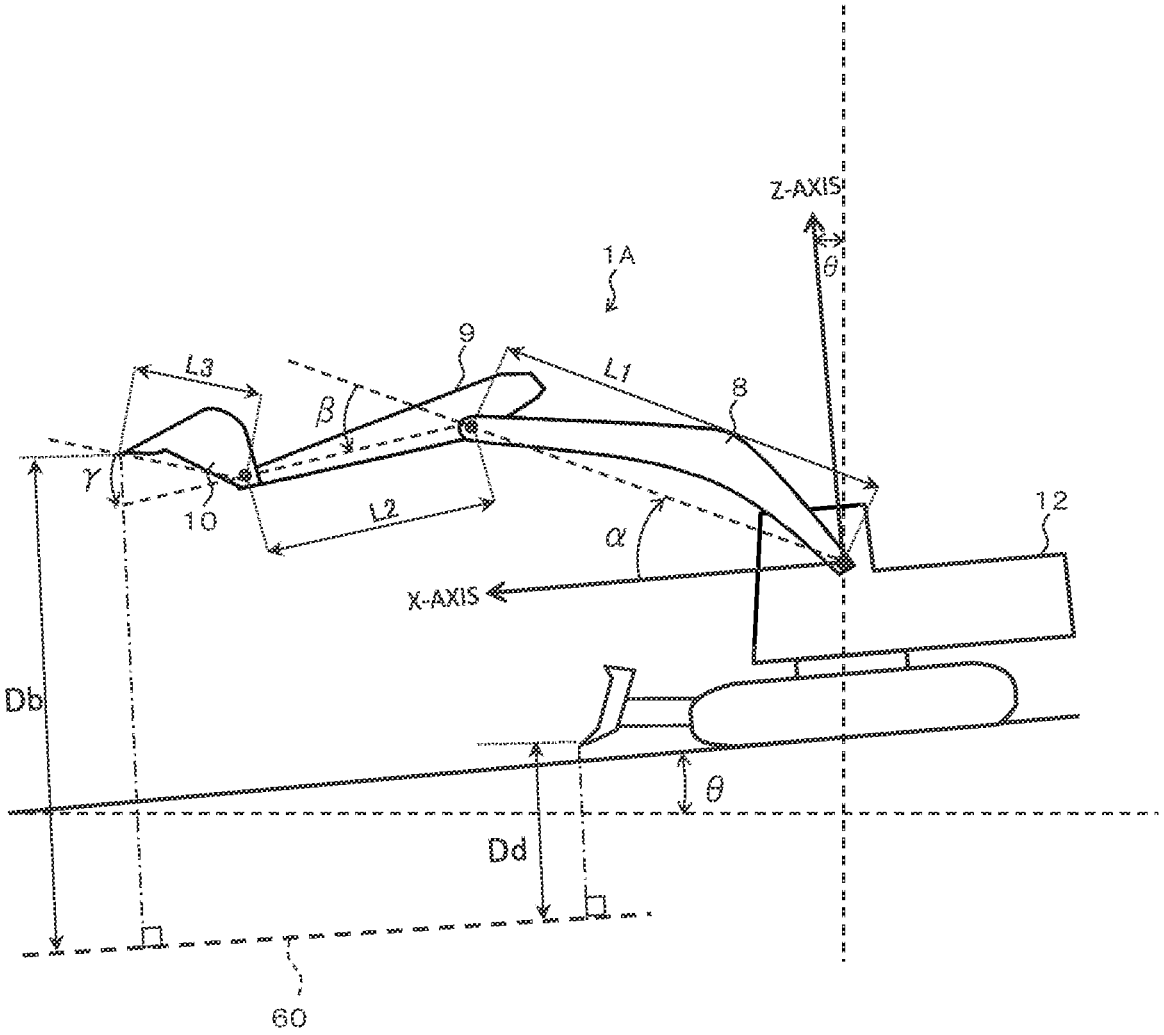
FIG. 7 is a diagram depicting a coordinate system and a target surface of the hydraulic excavator.

The posture of the front work device 1A can be defined in an excavator coordinate system (local coordinate system) of FIG. 7. The excavator coordinate system (XZ coordinate system) of FIG. 7 is the coordinate system set to the upper swing structure 12, a base portion of the boom 8 rotatably supported by the upper swing structure 12 is defined as an origin, a Z-axis is set in the vertical direction of the upper swing structure 12, and an X-axis is set in a horizontal direction thereof. It is defined that a tilting angle of the boom 8 with respect to the X-axis is a boom angle $\alpha$, a tilting angle of the arm 9 with respect to the boom 8 is an arm angle $\beta$, and a tilting angle of the bucket claw tip with respect to the arm is a bucket angle $\gamma$. It is defined that the tilting angle of the machine body 1B (upper swing structure 12) with respect to the horizontal plane (reference plane) is a tilting angle $\theta$. The boom angle $\alpha$ is detected by the boom angle sensor 30, the arm angle $\beta$ is detected by the arm angle sensor 31, the bucket angle $\gamma$ is detected by the bucket angle sensor 32, and the tilting angle $\theta$ is detected by the machine body tilting angle sensor 33. As specified in FIG. 7, if it is defined that lengths of the boom 8, the arm 9, and the bucket 10 are L1, L2, and L3, respectively, coordinates of the position of the bucket claw tip and the posture of the work device 1A in the excavator coordinate system can be expressed using L1, L2, L3, $\alpha$, $\beta$, and $\gamma$.

The posture of the blade work device 1C can be similarly defined. In this case, it is defined that a base portion (part denoted by reference character 103 in FIG. 2) of the dozer arm 26 is an origin, a W-axis is set in the vertical direction of the lower travel structure 11, a U-axis is set in the horizontal direction thereof, and a tilting angle of the dozer arm 26 with respect to the U-axis is a dozer angle $\delta$ (refer to FIG. 2). Since a distance from the base portion of the dozer arm 26 to the lower end of the blade 16 is fixed, coordinates of the blade lower end in a UW coordinate can be expressed using $\delta$. The coordinates of the blade lower end in the UW coordinate system can be converted into values in the global coordinate system on the basis of the coordinates of the upper swing structure 3 in the global coordinate system acquired by the swing structure position computing section 43Z and the swing angle detected by the swing angle sensor 104.

The front device position computing section 81*a* computes a posture of the front work device 1A and a position of the claw tip of the bucket 10 in the global coordinate system on the basis of the posture of the front work device 1A and the position of the claw tip of the bucket 10 in the local coordinate system obtained from the posture computing section 43*b* and the position of the upper swing structure 12 in the global coordinate system obtained from the swing structure position computing section 43*z*.

The blade position computing section 81*b* computes a posture of the blade work device 1C and a position of the lower end of the blade 16 in the global coordinate system on the basis of the posture of the blade work device 1C and the position of the lower end of the blade 16 in the local coordinate system obtained from the posture computing section 43*b* and the position of the upper swing structure 12 in the global coordinate system obtained from the swing structure position computing section 43*z*.

The target surface computing section 43*c* computes position information about the target surface 60 closest to the bucket tip end or the blade lower end on the basis of the three-dimensional data regarding the target surface in the global coordinate system obtained from the target surface setting device 51, the position of the claw tip of the bucket 10 in the global coordinate system obtained from the front device position computing section 81*a*, and the position of the lower end of the blade 16 in the global coordinate system obtained from the blade position computing section 81*b*, and stores the computed position information in the ROM 93. As depicted in FIG. 7, in Embodiment 1, a cross-sectional shape by cutting a three-dimensional target plane by a plane in which the work device 1A or 1C moves (action plane of the work device 1A or 1C) is used as the target surface 60 (two-dimensional target surface).

While one target surface 60 is present in an example of FIG. 7, a plurality of target surfaces are often present. The surface closest to each work device 1A or 1C is set as the target surface in Embodiment 1; thus, in a case in which a plurality of target surfaces are present, the front work device 1A and the blade work device 1C often differ in the target surface 60. To select the target surface of each work device 1A or 1C, for example, a method of selecting a surface located below the bucket claw tip or the blade lower end as the target surface, or a method of arbitrarily selecting a surface as the target surface can be used besides the above method.

Furthermore, the position information about the target surface 60 can be used for front device position computation, blade position computation, front device control, and blade control without the need to covert the computation result of the posture computing section 43*b* into global coordinates if the position information is converted into values in the local coordinate system (XZ coordinate system or UW coordinate system) used by the posture computing section 43*b*.

MG: Machine Guidance

The display changeover section 81*c* is a device that changes over the work device to be displayed on the display device 53 between the plurality of work devices 1A and 1C in accordance with the first input signal input from the display selection switch 96, and selectively causes the work device designated by the first input signal from between the plurality of work devices 1A and 1C to be displayed and causes a position of the target work object to be displayed on the display device 53. The posture of the front work device 1A and the position of the claw tip of the bucket 10 are input to the display changeover section 81*c* from the front device position computing section 81*a*, and the posture of the blade work device 1C and the position of the lower end of the blade 16 are input thereto from the blade position computing section 81*b*. As for the positions, the positions in whichever coordinate system may be input to the display changeover section 81*c* if the positions are uniform in coordinate system to the position information about the target surface 60 from the target surface computing section 43*c*. The display changeover section 81*c* outputs posture/position information in response to the pattern selected by the first input signal from the display selection switch 96 (changeover position of the switch 96) out of the posture/position information input from the front device position computing section 81*a* and that input from the blade position computing section 81*b* to the display control section 374. Specifically, types of pattern include the first pattern for displaying the front work device 1A, the second pattern for displaying the blade work device 1C, and the third pattern for displaying both of the two work devices 1A and 1C.

The position information about the target surface 60 is input to the display control section 374 from the target surface computing section 43*c*. The display control section 374 causes the work device 1A or 1C and the target surface 60 to be displayed on the display device 53 on the basis of the posture/position information about the work device from the display changeover device 81*c* as well as this position information about the target surface 60.

Figure 10:
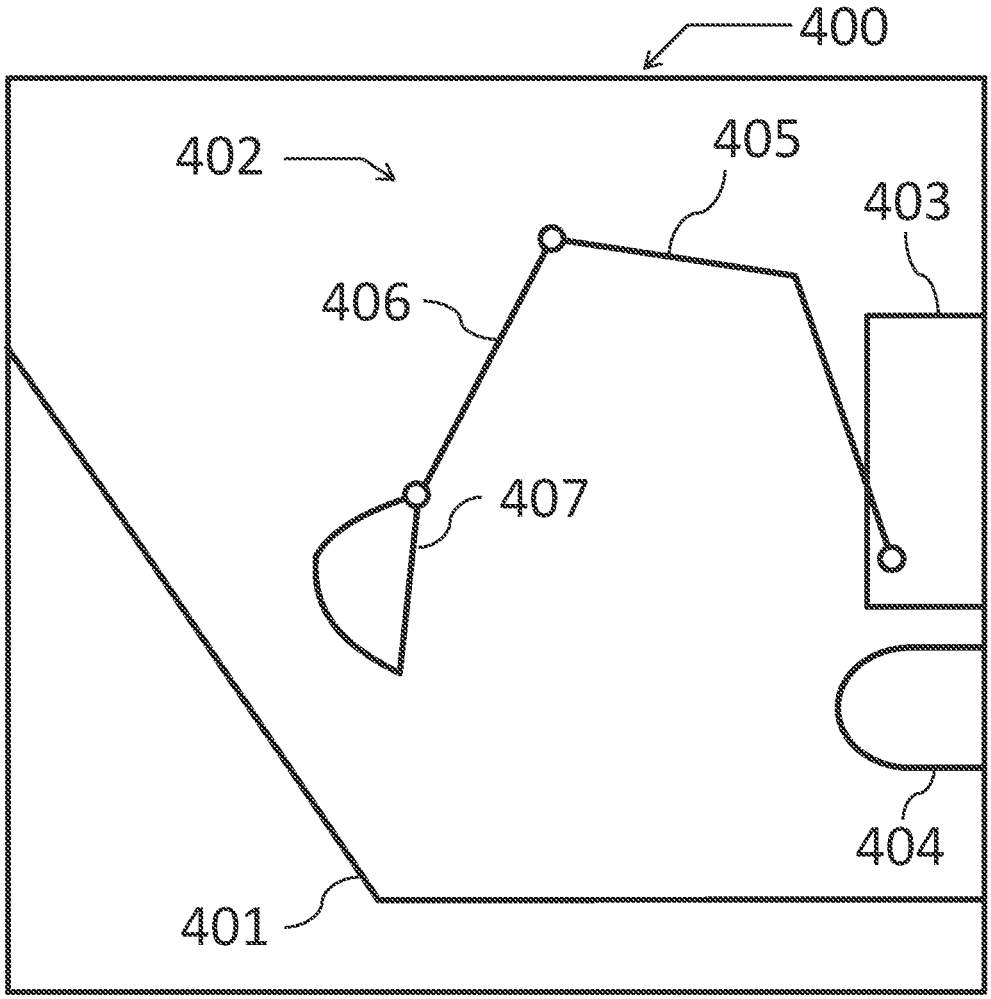
FIG. 10 is an example of a display screen in a first pattern for displaying a front work device.

FIG. 10 is an example of a display screen in the first pattern for displaying the front work device 1A. A line 401 of the target surface and a full view 402 of an excavator side surface are displayed within a screen 400 of the display device 53. In the excavator full view 402, full views 405, 406, and 407 of the boom 8, the arm 9, and the bucket 10 that are constituent elements of the front work device 1A as well as a full view 403 of the upper swing structure 12 and a full view 404 of the lower travel structure 11 are displayed. Checking the screen 400 enables the operator to grasp at which positions the machine body of the excavator and the front work device 1A are located with respect to the line 401 of the target surface 60.

Figure 11:
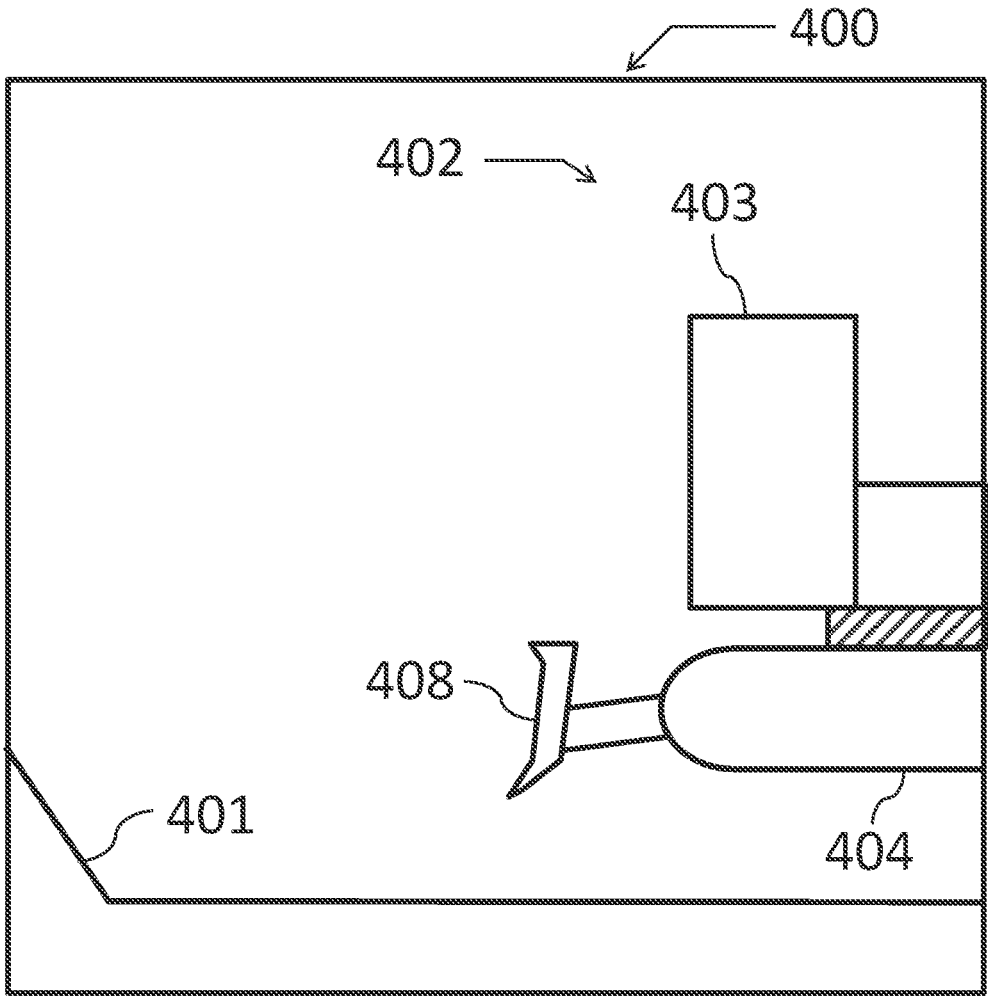
FIG. 11 is an example of a display screen in a second pattern for displaying a blade work device.

FIG. 11 is an example of a display screen in the second pattern for displaying the blade work device 1C. The line 401 of the target surface and the full view 402 of the excavator side surface are displayed within the screen 400 of the display device 53. In the excavator full view 402, a full view 408 of the blade work device 1C as well as the full view 403 of the upper swing structure 12 and the full view 404 of the lower travel structure 11 is displayed.

Furthermore, appropriately moving a display range of the screen 400 from FIG. 11 so that the blade position is located generally at a center in a lateral direction of the screen 400 facilitates checking a shape of the surrounding line 401 of the target surface around the blade 16. Checking the screen 400 enables the operator to grasp at which positions the machine body of the excavator and the blade work device 1C are located with respect to the line 401 of the target surface.

The structure of Embodiment 1 makes it possible for the display selection switch 96 to determine whether to select the front device position information or the blade position information as the position information to be displayed on the display device 53. Thus, the work machine capable of executing the MG not only over the front work device 1A but also over the blade work device 1C can be realized.

MC: Machine Control

The front device control section 81*d* is a device for executing MC controlling (semiautomatic control) to control the action of the front work device 1A in such a manner that the claw tip (control point) of the bucket 10 is located on or above the target surface 60 on the basis of the position of the target surface 60, the posture of the work device 1A, and the position of the claw tip of the bucket 10 at a time of operating the operation devices 45*a*, 45*b*, and 46*a*.

The blade control section 81*e* is a device for executing MC controlling (semiautomatic control) to control the action of the blade work device 1C in such a manner that the blade lower end (control point) is located on or above the target surface 60 on the basis of the position of the target surface 60, the posture of the work device 1C, and the position of the blade lower end at a time of operating the operation device 49.

The control changeover section 81*f* is a device that changes over the work device for which the MC is made valid between the plurality of work devices 1A and 1C in accordance with the second input signal input from the control selection switch 97. Target pilot pressures are input to the control changeover section 81*f* from the front device control section 81*d* and the blade control section 81*e*. The control changeover section 81 outputs the target pilot pressure in response to a pattern selected by the second input signal from the control selection switch 97 (changeover position of the switch 97) out of the target pilot pressures input from the front device control section 81*d* and the blade control section 81*e* to the solenoid proportional valve control section 44. Specifically, types of pattern include a first pattern for outputting the target pilot pressure from the front device control section 81*d* to control the front work device 1A, and a second pattern for outputting the target pilot pressure from the blade control section 81*e* to control the blade work device 1C.

Details of the MC executed by the front device control section 81*d* and the blade control section 81*e* will next be described with reference to the drawings.

Flowchart of MC Over Front Work Device 1A

Figure 12:
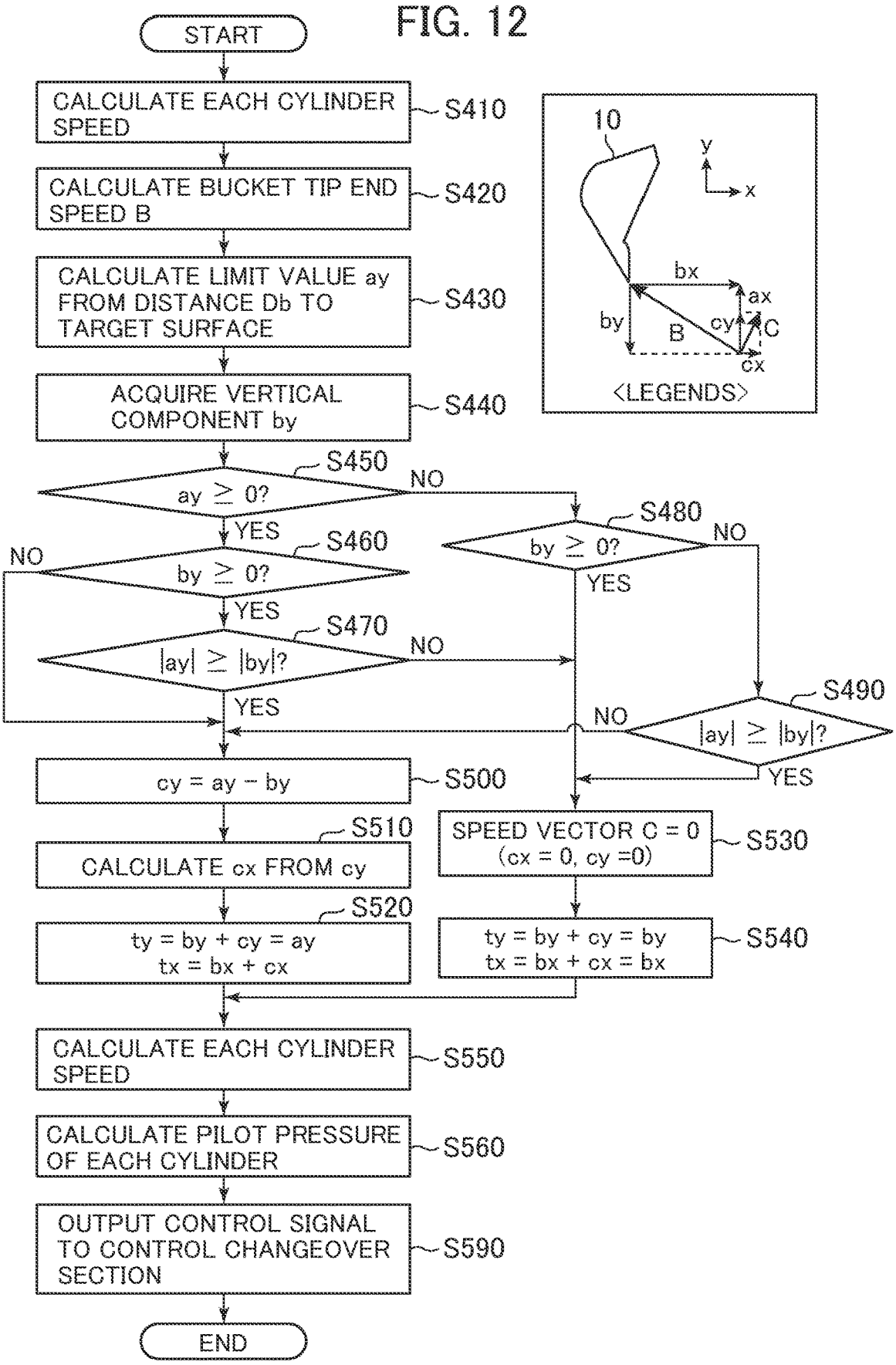
FIG. 12 is a flowchart of MC executed by a front device control section.

FIG. 12 is a flowchart of the MC executed by the front device control section 81*d*, and a process is started when the operator operates the operation devices 45*a*, 45*b*, and 46*a*.

In S410, the front device control section 81*d* computes action speeds (cylinder speeds) of the hydraulic cylinders 5, 6, and 7 on the basis of the operation amounts computed by the operation amount computing section 43*a*.

In S420, the front device control section 81*d* computes a speed vector B of the bucket tip end (claw tip) by an operator's operation on the basis of the action speeds of the hydraulic cylinders 5, 6, and 7 computed in S410 and the posture of the work device 1A computed by the posture computing section 43*b*.

Figure 13:
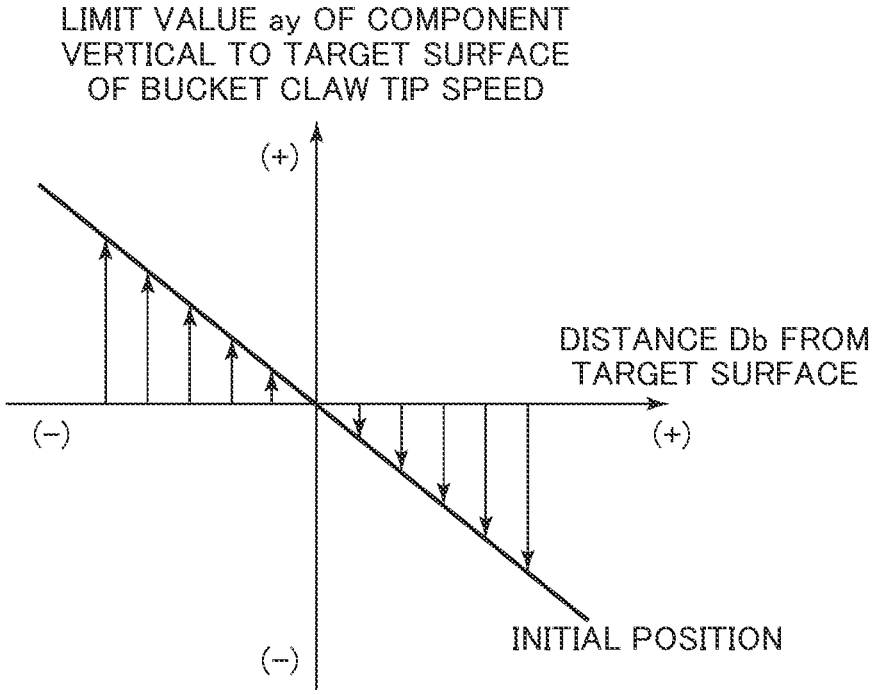
FIG. 13 is a diagram depicting a relationship between a limit value ay and a distance Db.

In S430, the front device control section 81*d* calculates a distance Db (refer to FIG. 7) from the bucket tip end to the target surface 60 to be controlled from the distance between the position (coordinates) of the claw tip of the bucket 10 computed by the posture computing section 43*b* and a straight line containing the target surface 60 stored in the ROM 93. The front device control section 81*d* then calculates a limit value ay of a vertical component to the target surface 60 in the speed vector of the bucket tip end on the basis of the distance Db and a graph of FIG. 13.

In S440, the front device control section 81*d* acquires a vertical component by to the target surface 60 in the speed vector B of the bucket tip end by the operator's operation calculated in S420.

In S450, the front device control section 81*d* determines whether the limit value ay calculated in S430 is equal to or greater than 0. It is noted that xy coordinates are set as depicted upper right in FIG. 12. In the xy coordinates, an x-axis is positive in a rightward direction in FIG. 12 parallel to the target surface 60 and a y-axis is positive in an upward direction therein vertical to the target surface 60. In legends in FIG. 12, the vertical component by and the limit value ay are negative and a horizontal component bx, a horizontal component cx, and a vertical component cy are positive. Furthermore, as is clear from FIG. 13, the limit value ay that is 0 corresponds to a case in which the distance Db is 0, that is, the claw tip is located on the target surface 60, the limit value ay that is positive corresponds to a case in which the distance Db is negative, that is, the claw tip is located below the target surface 60, and the limit value ay that is negative corresponds to a case in which the distance Db is positive, that is, the claw tip is located above the target surface 60. The front device control section 81*d* goes to S460 in a case of determining in S450 that the limit value ay is equal to or greater than 0 (that is, the claw tip is located on or below the target surface 60), and the front device control section 81*d* goes to S480 in a case in which the limit value ay is smaller than 0.

In S460, the front device control section 81*d* determines whether the vertical component by in the speed vector B of the claw tip by the operator's operation is equal to or greater than 0. A case in which the by is positive indicates that the vertical component by in the speed vector B is upward, and a case in which the by is negative indicates that the vertical component by in the speed vector B is downward. The front device control section 81*d* goes to S470 in a case of determining in S460 that the vertical component by is equal to or greater than 0 (that is, the vertical component by is upward), and goes to S500 in a case in which the vertical component by is smaller than 0.

In S470, the front device control section 81*d* compares an absolute value of the limit value ay with an absolute value of the vertical component by, and goes to S500 in a case in which the absolute value of the limit value ay is equal to or greater than that of the vertical component by. On the other hand, the front device control section 81*d* goes to S530 in a case in which the absolute value of the limit value ay is smaller than that of the vertical component by.

In S500, the front device control section 81*d* selects "cy=ay−by" as an equation for calculating the vertical component cy to the target surface 60 in a speed vector C of the bucket tip end to be generated by an action of the boom 8 under machine control, and calculates the vertical component cy on the basis of the equation, the limit value ay in S430, and the vertical component by in S440. The front device control section 81*d* then calculates the speed vector C capable of outputting the calculated vertical component cy and sets a horizontal component in the speed vector C to the cx (S510).

In S520, the front device control section 81*d* calculates a target speed vector T. Assuming that a vertical component to the target surface 60 in the target speed vector T is ty and a horizontal component therein is tx, the vertical component ty and the horizontal component tx can be expressed as "ty=by+cy, tx=bx+cx," respectively. By substituting the equation (cy=ay−by) in S500 into the ty and the tx, the target speed vector T is eventually expressed as "ty=ay, tx=bx+cx." In other words, the vertical component ty in the target speed vector in a case of going to S520 is limited by the limit value ay and forced boom raising under machine control is actuated.

In S480, the front device control section 81*d* determines whether the vertical component by in the speed vector B of the claw tip by the operator's operation is equal to or greater than 0. The front device control section 81*d* goes to S530 in a case of determining in S480 that the vertical component by is equal to or greater than 0 (that is, the vertical component by is upward), and goes to S490 in a case in which the vertical component by is smaller than 0.

In S490, the front device control section 81*d* compares the absolute value of the limit value ay with the absolute value of the vertical component by, and goes to S530 in the case in which the absolute value of the limit value ay is equal to or greater than that of the vertical component by. On the other hand, the front device control section 81*d* goes to S500 in the case in which the absolute value of the limit value ay is smaller than that of the vertical component by.

In a case of going to S530, the front device control section 81*d* sets the speed vector C to zero since it is unnecessary to cause the boom 8 to move under machine control. In this case, the target speed vector T is expressed as "ty=by, tx=bx" if being on the basis of the equation (ty=by+cy, tx=bx+cx) used in S520, and the target speed vector T matches the speed vector B by the operator's operation (S540).

In S550, the front device control section 81*d* computes target speeds of the hydraulic cylinders 5, 6, and 7 on the basis of the target speed vector T (ty, tx) determined in S520 or S540. While it is clear from the above description, the target speed vector T is realized by adding the speed vector C generated by the action of the boom 8 under machine control to the speed vector B in a case in which the target speed vector T does not match the speed vector B in FIG. 12.

In S560, the front device control section 81*d* computes the target pilot pressures, which are to act on the flow control valves 15*a*, 15*b*, and 15*c* for the hydraulic cylinders 5, 6, and 7, on the basis of the target speeds of the cylinders 5, 6, and 7 calculated in S550.

In S590, the front device control section 81*d* outputs the target pilot pressures, which are to act on the flow control valves 15*a*, 15*b*, and 15*c* for the hydraulic cylinders 5, 6, and 7, to the control changeover section 81*f*.

In a case in which the control selection switch 97 selects the first pattern for executing the MC over the front work device 1A and the target pilot pressures output in S590 are input to the solenoid proportional valve control section 44, the solenoid proportional valve control section 44 controls the solenoid proportional valves 54, 55, and 56 so that the target pilot pressures act on the flow control valves 15*a*, 15*b*, and 15*c* for the hydraulic cylinders 5, 6, and 7, whereby the work device 1A performs excavation. For example, in a case of operator's operating the operation device 45*b* and performing horizontal excavation by the arm crowding action, then the solenoid proportional valve 55*c* is controlled in such a manner that the tip end of the bucket 10 does not enter the target surface 60, and an action of raising the boom 8 is performed automatically.

While the front device control section 81*d* is structured to go to S530 in a case in which a determination result of S480 is YES for the brevity of description, the structure of the front device control section 81*d* may be changed such that the front device control section 81*d* goes to S500 as an alternative to going to S530. With such a structure, further performing an arm crowding operation from a position at which a posture of the arm 9 is generally vertical causes forced boom lowering to be actuated under machine control to perform excavation along the target surface 60; thus, it is possible to increase an excavation distance along the target surface 60. Furthermore, while the case of performing the forced boom raising is taken in the flowchart of FIG. 12 by way of example, control to reduce the speed of the arm 9 may be added to the machine control. Moreover, control to keep the angle of the bucket 10 to a desired angle by controlling the solenoid proportional valves 56*c* and 56*d* may be added to the machine control so that the angle B of the bucket 10 with respect to the target surface 60 is a fixed value to facilitate leveling work.

Flowchart of MC Over Blade Work Device 1C

Figure 14:
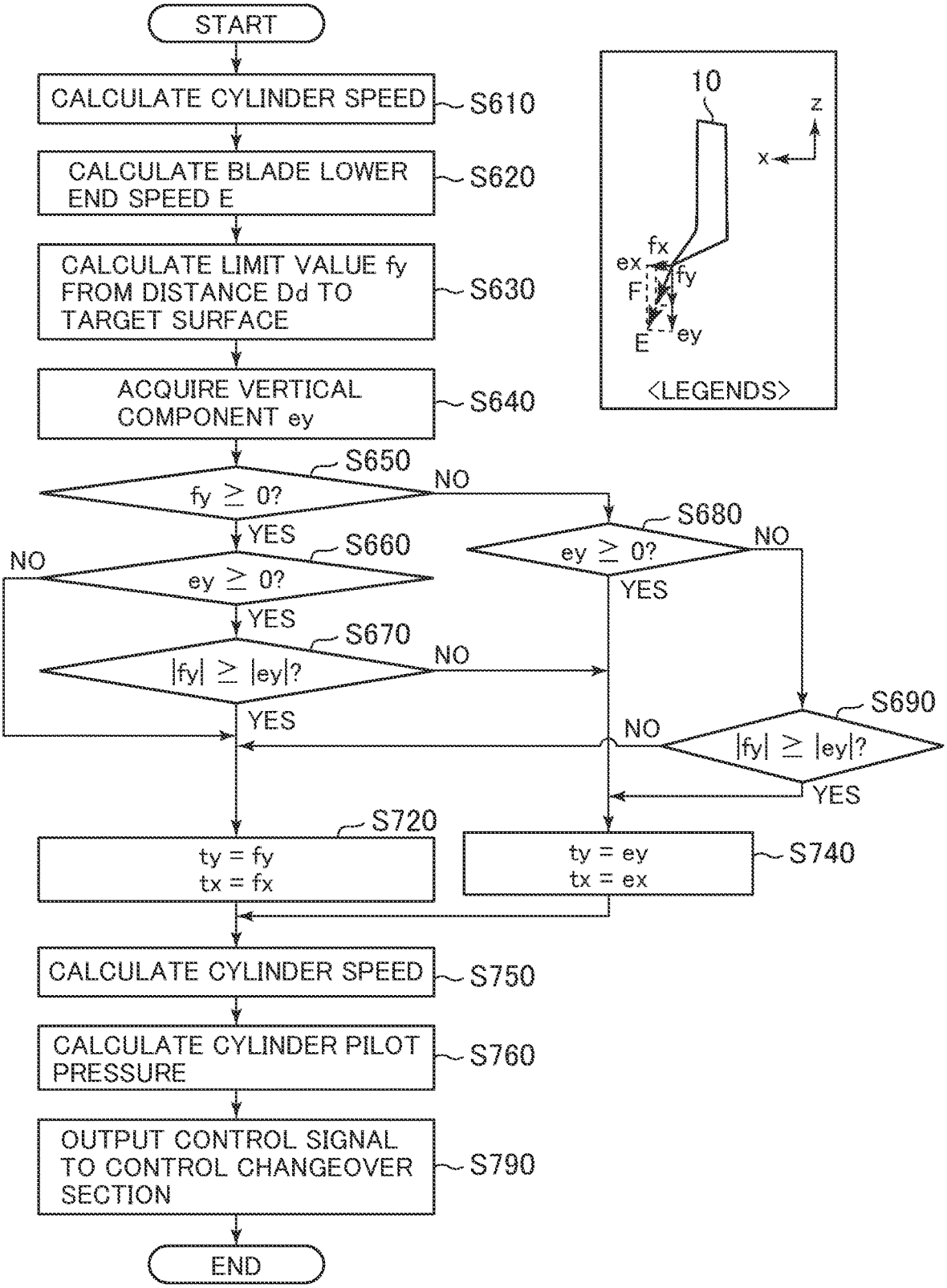
FIG. 14 is a flowchart of MC executed by a blade control section.

FIG. 14 is a flowchart of the MC executed by the blade control section 81*e*.

In S610, the blade control section 81*e* computes an action speed (cylinder speed) of the hydraulic cylinder 14 on the basis of the operation amount computed by the operation amount computing section 43*a*.

In S620, the blade control section 81*e* computes a speed vector E of the blade lower end by an operator's operation on the basis of the action speed of the hydraulic cylinder 14 computed in S610 and the posture of the work device 1C computed by the posture computing section 43*b*.

Figure 15:
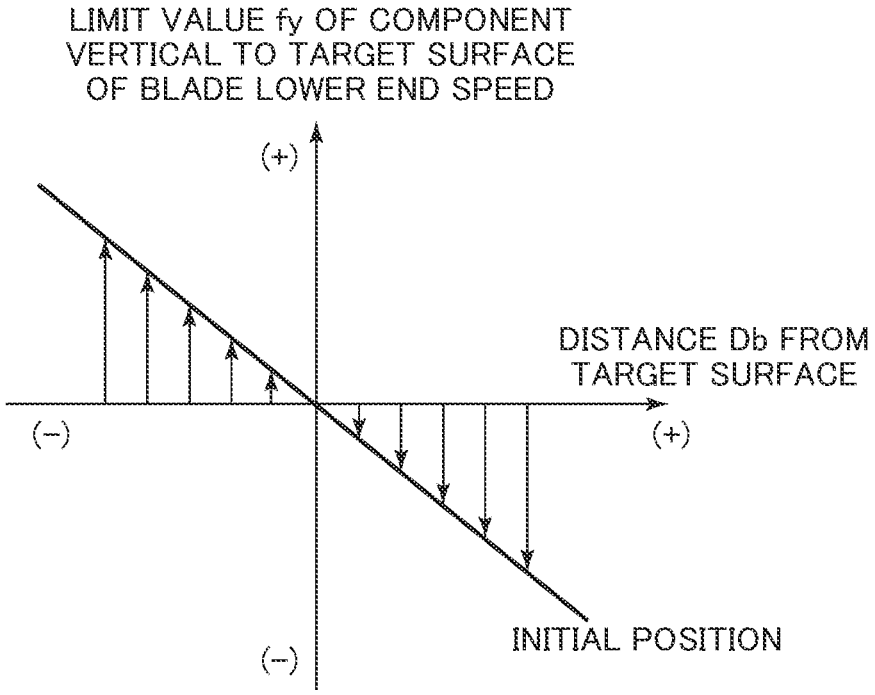
FIG. 15 is a diagram depicting a relationship between a limit value fy and a distance Dd.

In S630, the blade control section 81*e* calculates a distance Dd (refer to FIG. 7) from the blade lower end to the target surface 60 to be controlled from the distance between the position (coordinates) of the blade lower end computed by the posture computing section 43*b* and the straight line containing the target surface 60 stored in the ROM 93. The blade control section 81*e* then calculates a limit value fy of a vertical component to the target surface 60 in the speed vector of the bucket tip end on the basis of the distance Dd and a graph of FIG. 15.

In S640, the blade control section 81*e* acquires a vertical component ey to the target surface 60 in the speed vector E of the blade lower end by the operator's operation calculated in S620.

In S650, the blade control section 81*e* determines whether the limit value fy calculated in S630 is equal to or greater than 0. It is noted that xy coordinates are set as depicted upper right in FIG. 14. In the xy coordinates, an x-axis is positive in a rightward direction in FIG. 14 parallel to the target surface 60 and a y-axis is positive in an upward direction therein vertical to the target surface 60. In legends in FIG. 14, the vertical component ey and the limit value fy are negative and a horizontal component ex and a horizontal component fx are positive. Furthermore, as is clear from FIG. 15, the limit value fy that is 0 corresponds to a case in which the distance Dd is 0, that is, the blade lower end is located on the target surface 60, the limit value fy that is positive corresponds to a case in which the distance Dd is negative, that is, the blade lower end is located below the target surface 60, and the limit value fy that is negative corresponds to a case in which the distance Dd is positive, that is, the blade lower end is located above the target surface 60. The blade control section 81*e* goes to S660 in a case of determining in S460 that the limit value fy is equal to or greater than 0 (that is, the blade lower end is located on or below the target surface 60), and the blade control section 81*e* goes to S680 in a case in which the limit value fy is smaller than 0.

In S660, the blade control section 81*e* determines whether the vertical component ey in the speed vector E of the claw tip by the operator's operation is equal to or greater than 0. A case in which the ey is positive indicates that the vertical component ey in the speed vector E is upward, and a case in which the ey is negative indicates that the vertical component by in the speed vector E is downward. The blade control section 81*e* goes to S670 in a case of determining in S660 that the vertical component ey is equal to or greater than 0 (that is, the vertical component ey is upward), and goes to S720 in a case in which the vertical component ey is smaller than 0.

In S670, the blade control section 81*e* compares an absolute value of the limit value fy with an absolute value of the vertical component ey, and goes to S720 in a case in which the absolute value of the limit value fy is equal to or greater than that of the vertical component ey. On the other hand, the blade control section 81*e* goes to S740 in the case in which the absolute value of the limit value fy is smaller than that of the vertical component ey.

In S720, the blade control section 81*e* calculates the target speed vector T. Assuming that the vertical component to the target surface 60 in the target speed vector T is ty and the horizontal component therein is tx, the vertical component ty and the horizontal component tx can be expressed as "ty=fy, tx=fx," respectively. In other words, the vertical component ty in the target speed vector in a case of going to S720 is limited by the limit value fy and a forced blade action under machine control is actuated.

In S680, the blade control section 81*e* determines whether the vertical component ey in the speed vector E of the blade lower end by the operator's operation is equal to or greater than 0. The blade control section 81*e* goes to S740 in a case of determining in S680 that the vertical component ey is equal to or greater than 0 (that is, the vertical component ey is upward), and goes to S690 in a case in which the vertical component ey is smaller than 0.

In S690, the blade control section 81*e* compares the absolute value of the limit value fy with the absolute value of the vertical component ey, and goes to S740 in a case in which the absolute value of the limit value fy is equal to or greater than that of the vertical component ey. On the other hand, the blade control section 81*e* goes to S720 in the case in which the absolute value of the limit value fy is smaller than that of the vertical component ey.

In a case of going to S740, the blade control section 81*e* sets the target speed vector T is "ty=ey, tx=ex" since it is unnecessary to control the blade 16 under machine control, and the target speed vector T matches the speed vector E by the operator's operation (S740).

In S750, the blade control section 81*e* computes a target speed of the hydraulic cylinder 14 on the basis of the target speed vector T (ty, tx) determined in S720 or S740.

In S760, the blade control section 81*e* computes the target pilot pressure, which is to act on the flow control valve 15*g* for the hydraulic cylinder 14, on the basis of the target speed of the hydraulic cylinder 14 calculated in S750.

In S790, the blade control section 81*e* outputs the target pilot pressure, which is to act on the flow control valve 15*g* for the hydraulic cylinder 14, to the control changeover section 81*f*.

In a case in which the control selection switch 97 selects the second pattern for executing the MC over the blade work device 1C and the target pilot pressure output in S790 is input to the solenoid proportional valve control section 44, the solenoid proportional valve control section 44 controls the solenoid proportional valve 57 so that the target pilot pressure acts on the flow control valve 15*g* for the hydraulic cylinder 14, whereby the work device 1C performs a vertical action. For example, in a case of operator's operating the operation device 49 and performing height adjustment of the blade 16, then the solenoid proportional valve 57 is controlled in such a manner that the lower end of the blade 16 does not enter the target surface 60, and an action of the blade 16 is performed automatically.

With the structure of Embodiment 1 described above, the control selection switch 97 can select whether to make valid the MC over the front work device 1A or to make valid the MC over the blade work device 1C. Thus, the work machine capable of executing the MC not only over the front work device 1A but also over the blade work device 1C can be realized.

Embodiment 2

Embodiment 2 of the present invention will next be described. Embodiment 2 is characterized in that changeovers by the display changeover section 81*c* and the control changeover section 81*f* are performed not using the switches 96 and 97 but on the basis of the distances Db and Dd between the target surface 60 and the work devices. The same parts as those in Embodiment 1 are denoted by the same reference characters and are often not described.

Figure 16:
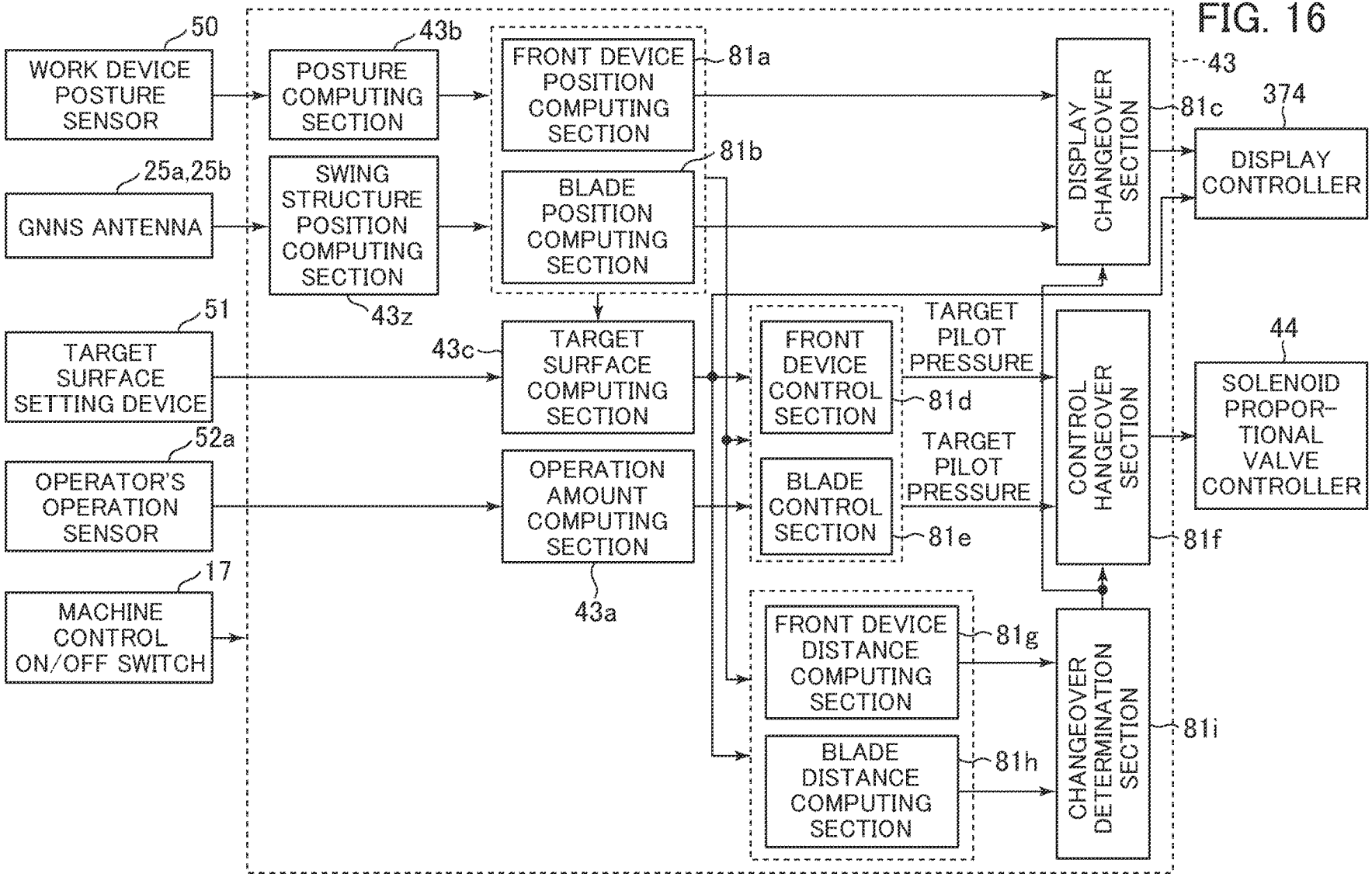
FIG. 16 is a functional block diagram of an MG/MC controller according to Embodiment 2.

FIG. 16 is a functional block diagram of the MG/MC control section 43 according to Embodiment 2 of the present invention. The controller 43 of Embodiment 2 is provided with a front device distance computing section 81*g*, a blade distance computing section 81*h*, and a changeover determination section 81*i* in addition to the structure of the controller 43 of Embodiment 1. Furthermore, in a system of Embodiment 2, the display selection switch 96 and the control selection switch 97 are excluded from the system structure of Embodiment 1.

Figure 17:
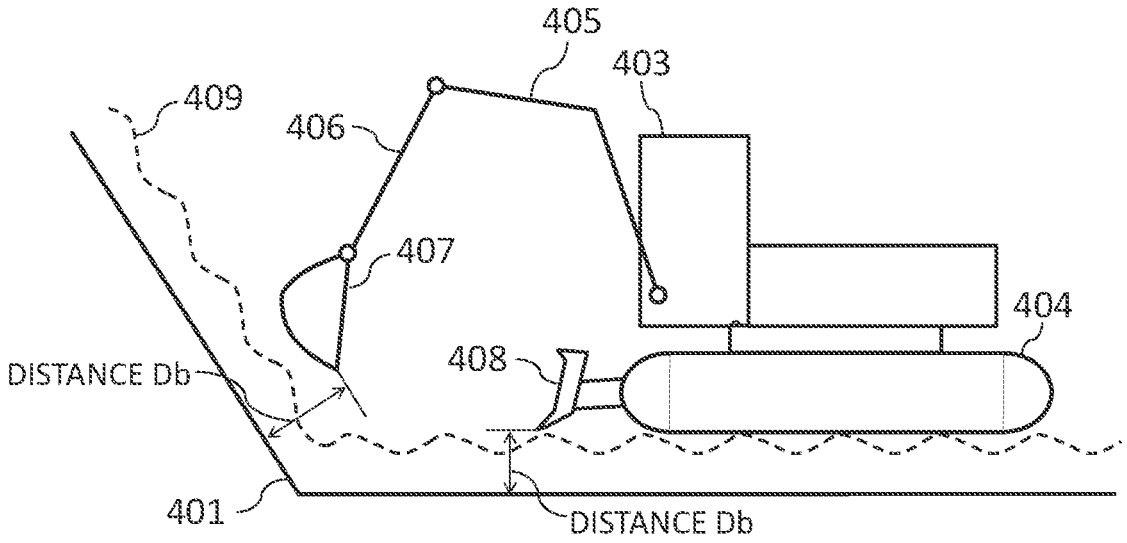
FIG. 17 is a diagram depicting a shortest distance Db from a target surface to a bucket claw tip and the shortest distance Dd from the target surface to a blade lower end.

The front device distance computing section 81*g* is a device that computes a shortest distance (distance Db in FIG. 17) between the line 401 of the target surface and the bucket claw tip (front work device tip end) by the target surface information from the target surface computing section 43*c* and the posture/position information about the front work device 1A from the front device position computing section 81*a*. It is noted that a dotted line denoted by reference character 409 in FIG. 17 indicates a geographical surface during work.

The blade distance computing section 81*h* is a device that computes a shortest distance (distance Dd in FIG. 17) between the line 401 of the target surface and the blade lower end by the target surface information from the target surface computing section 43*c* and the posture/position information about the blade work device 1C from the blade position computing section 81*b*.

MG: Machine Guidance

The changeover determination section 81*i* is a device that acquires the distance (first distance) Db between the target surface 60 and the bucket claw tip computed by the front device distance computing section 81*g* and the distance (second distance) Dd between the target surface 60 and the blade lower end computed by the blade distance computing section 81*h*, that determines the work device to be displayed on the display device 53 out of the two work devices 1A and 1C on the basis of the two distances Db and Dd, and that outputs the first input signal based on the determination to the display changeover section 81*c*.

A method of changing over the work device to be displayed on the display device 53 on the basis of the two distances Db and Dd by the changeover determination section 81*i* will be described with reference to FIG. 18.

Figure 18:
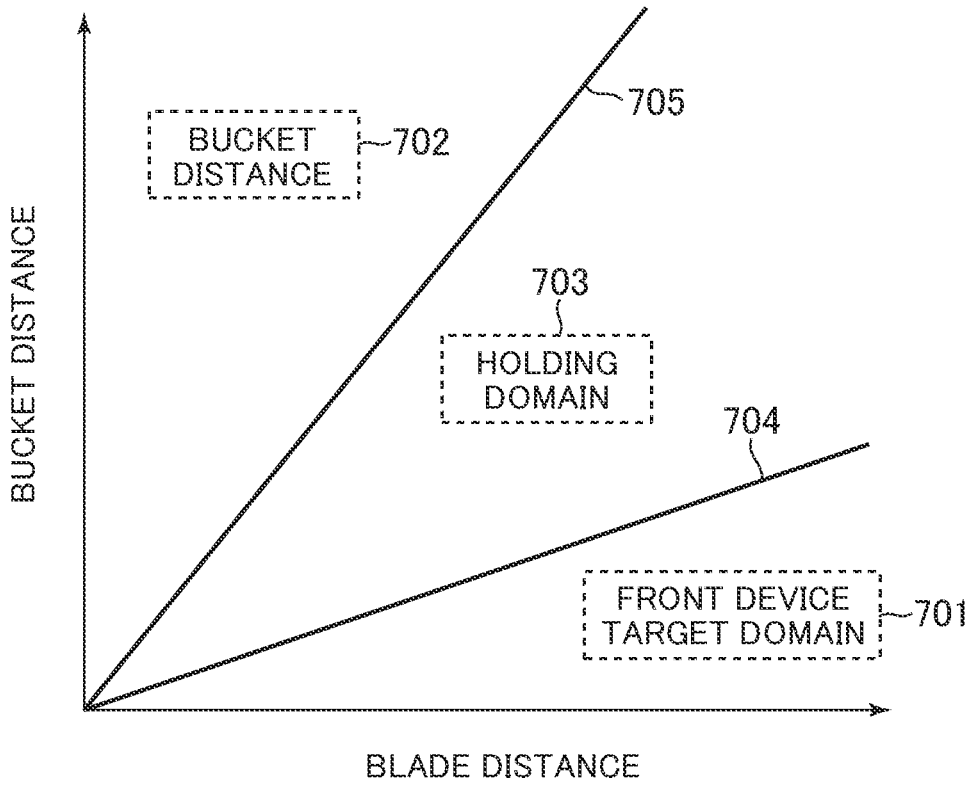
FIG. 18 is a diagram depicting a relationship between a combination of the bucket distance Db and the blade distance Dd and a work device subjected to MG/MC.

In FIG. 18, a domain 701 in which the first input signal indicating that the front work device 1A is subjected to the MG is output, a domain 702 in which the first input signal indicating that the blade work device 1C is subjected to the MG is output, and a domain 703 in which the first input signal indicating that the work device which is being subjected to the MG at timing of each computation is held is output are present for a combination of the blade distance Dd and the bucket distance Db. The front device target domain 701 and the holding domain 703 are demarcated by a demarcation line 704 that is represented by a straight line having an inclination smaller than 1 and passing through an origin, and the blade target domain 702 and the holding domain 703 are demarcated by a demarcation line 705 that is represented by a straight line having an inclination greater than 1 and passing through the origin.

By demarcating the target domains as depicted in FIG. 18, in a case, for example, in which the bucket distance Db is relatively short and the blade distance Dd is relatively long, a combination between the distances Db and Dd enters first the front device target domain 701; thus, the front work device 1A is subjected to the MG. In a case in which the combination enters the holding domain 703 beyond the demarcation line 704 in the state, the work device which is being subjected to the MG is held; thus, the front work device 1A is kept subjected to the MG. In a case in which the combination enters the blade target domain 702, in which the bucket distance Db is relatively long and the blade distance is relatively short, further beyond the demarcation line 705 in the above state, the work device subjected to the MG is changed from the front work device 1A to the blade work device 1C.

As a result, when determining that the front work device 1A is subjected to the MG, the changeover determination section 81*i* outputs the first input signal indicating the first pattern for displaying the front work device 1A to the display changeover section 81*c*. The display device control section 374 thereby causes the work device 1A and the target surface 60 to be displayed on the display device 53 as depicted in FIG. 10. Conversely, when determining that the blade work device 1C is subjected to the MG, the changeover determination section 81*i* outputs the first input signal indicating the second pattern for displaying the blade work device 1C to the display changeover section 81*c*. The display device control section 374 thereby causes the work device 1C and the target surface 60 to be displayed on the display device 53 as depicted in FIG. 11.

With the structure of Embodiment 2, causing the changeover determination section 81*i* to automatically output the first input signal on the basis of classification of the domains depicted in FIG. 18 makes it possible to determine that the blade 16 is subjected to the MG without an operator's special operation when the front work device 1A is raised and the blade 16 is lowered for conducting, for example, blade work. Thus, the work machine capable of performing the MG not only over the front work device 1A but also over the blade 16 can be realized.

MC: Machine Control

Furthermore, the changeover determination section 81*i* also serves as a device that determines the work device for which the MC is made valid out of the two work devices 1A and 1C on the basis of the two acquired distances Db and Dd, and that outputs the second input signal based on the determination to the control changeover section 81*f*.

A method of changing over the work device for which the MC is made valid between the two work devices 1A and 1C on the basis of the two distances Db and Dd is executed by the changeover determination section 81*i* in accordance with FIG. 18 similarly to the changeover of the work device subjected to the MG described previously.

By demarcating the target domains as depicted in FIG. 18, in the case, for example, in which the bucket distance Db is relatively short and the blade distance Dd is relatively long, the combination enters first the front device target domain 701; thus, the front work device 1A is subjected to the MC (MC is made valid for the front work device 1A). In the case in which the combination enters the holding domain 703 beyond the demarcation line 704 in the state, the work device subjected to the MC is held; thus, the front work device 1A is kept subjected to the MC. In the case in which the combination enters the blade target domain 702, in which the bucket distance Db is relatively long and the blade distance is relatively short, further beyond the demarcation line 705 in the above state, the work device subjected to the MC is changed from the front work device 1A to the blade work device 1C.

As a result, when determining that the MC is valid for the front work device 1A, the changeover determination section 81*i* outputs the second input signal indicating the first pattern for making valid the MC over the front work device 1A to the control changeover section 81*f*. The solenoid proportional valve 44 thereby actuates the MC over the front work device 1A. Conversely, when determining that the MC is valid for the blade work device 1C, the changeover determination section 81*i* outputs the second input signal indicating the second pattern for making valid the MC over the blade work device 1C to the control changeover section 81*f*. The solenoid proportional valve 44 thereby actuates the MC over the blade work device 1C.

With the structure of Embodiment 2, causing the changeover determination section 81*i* to automatically output the second input signal on the basis of the classification of the domains depicted in FIG. 18 makes it possible to determine that the blade 16 is subjected to the MC without an operator's special operation when the front work device 1A is raised and the blade 16 is lowered for conducting, for example, the blade work. Thus, the work machine capable of performing the MC not only over the front work device 1A but also over the blade 16 can be realized.

Figure 19:
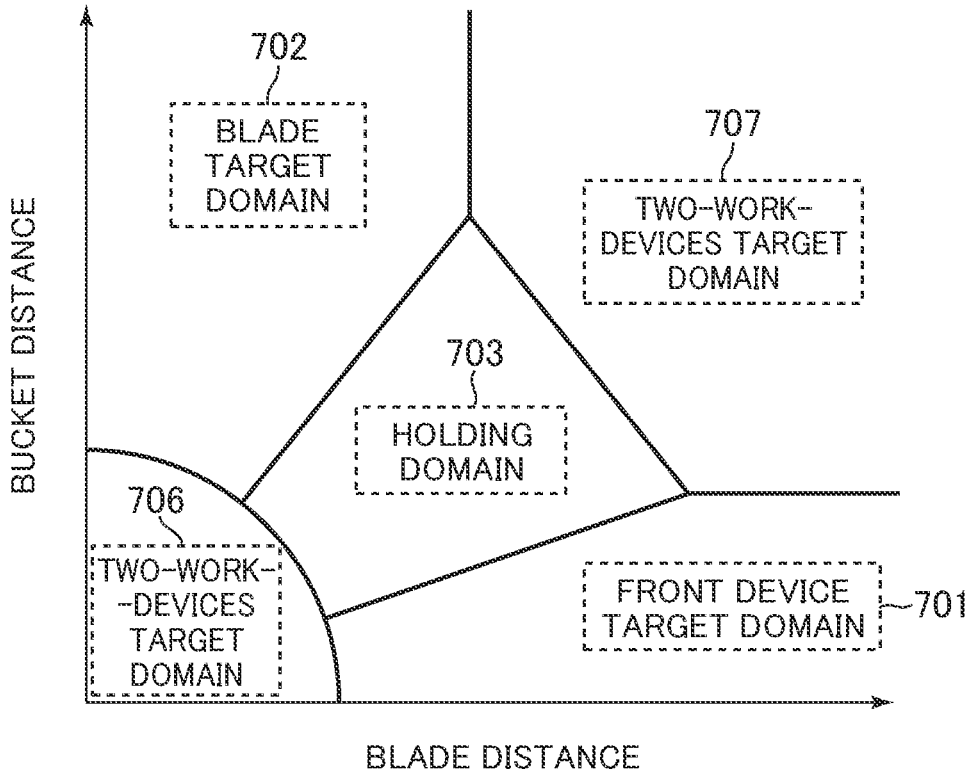
FIG. 19 is a diagram depicting a relationship between the combination of the bucket distance Db and the blade distance Dd and the work device subjected to MG/MC.

It is noted that a domain structure of FIG. 18 may be replaced by a structure of domains depicted in FIG. 19. In other words, in an example of FIG. 19, two-work-devices target domains 706 and 707, in which the changeover determination section 81*i* outputs the first input signal or the second input signal indicating that both of the two work devices 1A and 1C are subjected to the MG or MC in a case in which the distances Db and Dd of the bucket 10 and the blade 16 to the target surface 60 are both short or both long are set.

Structuring the domains in this way enables the operator to simultaneously check the positions of the two work devices 1A and 1C at a time of the MG and to actuate the MC over the two work devices 1A and 1C at a time of the MC.

Embodiment 3

Embodiment 3 of the present invention will next be described. Embodiment 3 is characterized in that changeovers by the display changeover section 81*c* and the control changeover section 81*f* are performed not on the basis of the distances Db and Dd between the target surface 60 and the work devices but on the basis of the relative swing angle (hereinafter, also simply referred to as "swing angle")

between the upper swing structure 12 and the lower travel structure 11 calculated by the posture computing section 43*b* on the basis of the output from the swing angle sensor 104. The same parts as those in Embodiments 1 and 2 are denoted by the same reference characters and are often not described.

Figure 20:
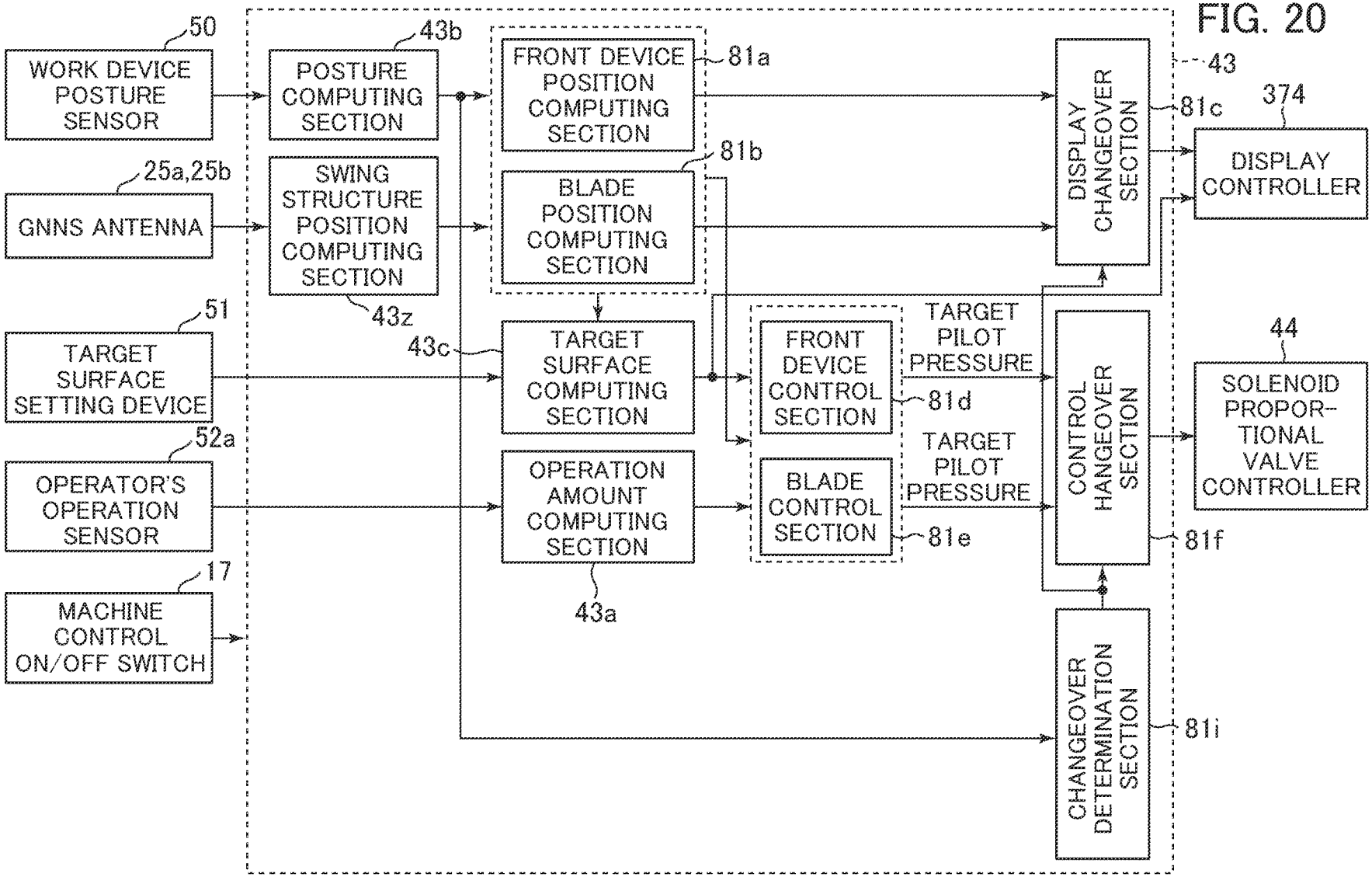
FIG. 20 is a functional block diagram of an MG/MC controller according to Embodiment 3.

FIG. 20 is a functional block diagram of the MG/MC control section 43 according to Embodiment 3 of the present invention. The controller 43 of Embodiment 3 is such that the front device distance computing section 81*g* and the blade distance computing section 81*h* are excluded from the structure of the controller 43 of Embodiment 2, and the relative swing angle between the upper swing structure 12 and the lower travel structure 11 is input from the posture computing section 43*b* to the changeover determination section 81*i*.

MG: Machine Guidance

The changeover determination section 81*i* is a device that acquires the relative swing angle between the upper swing structure 12 and the lower travel structure 11 computed by the posture computing section 43*b*, that determines the work device to be displayed on the display device 53 out of the two work devices 1A and 1C on the basis of angle information, and that outputs the first input signal based on the determination to the display changeover section 81*c*.

A method of changing over information to be displayed on the display device 53 on the basis of the relative swing angle between the upper swing structure 12 and the lower travel structure 11 by the changeover determination section 81*i* will be described.

The changeover determination section 81*i* acquires the swing angle of the lower travel structure 11 with respect to the upper swing structure 12 computed by the posture computing section 43*z*, and determines whether the swing angle falls in a predetermined range set in advance. When determining that the swing angle is in the predetermined range, the changeover determination section 81*i* outputs the first input signal indicating that the blade work device 1C is subjected to the MG. On the other hand, when determining that the swing angle is out of the predetermined range, the changeover determination section 81*i* outputs the first input signal indicating that the front work device 1A is subjected to the MG.

The "predetermined range" of the swing angle is defined as a range up to predetermined swing angles at which the upper swing structure 12 swings left and right from a reference position, which is assumed as a position at which a frontward direction of the upper swing structure 12 (direction in which the front work device 1A is attached in the upper swing structure 12) matches a forward movement direction of the lower travel structure 11 (direction in which the blade work device 1C is attached in the lower travel structure 11). While an optimum value of the predetermined range is not clearly present, for example, a range within 45 degrees leftward from the reference position and a range within 45 degrees rightward from the reference position can be defined as the predetermined range. Furthermore, it is preferable that the predetermined range can be changed depending on the work content or operator's preference and the left and right ranges may be set differently. Moreover, an angle of the reference position may be assumed as zero degree, a coordinate system at an angle increased from zero degree up to 360 degrees in a rightward direction (which may be a leftward direction) may be set, and the predetermined range may be determined in this coordinate system. In this case, the predetermined range includes two ranges, that is, a range from zero degree to $\theta 1$ and a range from $\theta 2$ to 360 degrees (zero degree) (where $\theta 1<\theta 2$). It is noted that the reference position is not limited to the above position but may be set to an arbitrary position.

The swing angle being in the predetermined range is regarded as the case of which the frontward direction of the upper swing structure 12 matches the forward movement direction of the lower travel structure 11, while the swing angle being out of the predetermined range is regarded as the case of which the frontward direction of the upper swing structure 12 does not match the forward movement direction of the lower travel structure 11. In this case, when the swing angle is, for example, out of the predetermined range, the frontward direction of the upper swing structure 12 does not match the forward movement direction of the lower travel structure 11; thus, the changeover determination section 81*i* determines that work is being conducted by the front work device 1A and that the front work device 1A is subjected to the MG. On the other hand, when the swing angle is in the predetermined range, the frontward direction of the upper swing structure 12 matches the forward movement direction of the lower travel structure 11; thus, the changeover determination section 81*i* determines that work is possibly conducted by the blade work device 1C and that the blade work device 1C is subjected to the MG.

As a result, when determining that the front work device 1A is subjected to the MG, the changeover determination section 81*i* outputs the first input signal indicating the first pattern for displaying the front work device 1A to the display changeover section 81*c*. The display device control section 374 thereby causes the work device 1A and the target surface 60 to be displayed on the display device 53 as depicted in FIG. 10. Conversely, when determining that the blade work device 1C is subjected to the MG, the changeover determination section 81*i* outputs the first input signal indicating the second pattern for displaying the blade work device 1C to the display changeover section 81*c*. The display device control section 374 thereby causes the work device 1C and the target surface 60 to be displayed on the display device 53 as depicted in FIG. 11.

With the structure of Embodiment 3, causing the changeover determination section 81*i* to automatically output the first input signal on the basis of the swing angle of the lower travel structure 11 with respect to the upper swing structure 12 makes it possible to determine that the blade 16 is subjected to the MG without an operator's special operation when the frontward direction of the upper swing structure 12 is made to match the travelling direction of the lower travel structure 11 for conducting, for example, the blade work. Thus, the work device 1C is displayed on the display device 53. Accordingly, the work machine capable of executing the MG not only over the front work device 1A but also over the blade work device 1C can be realized. Furthermore, the blade position information may be computed for the MG only when the frontward direction of the upper swing structure 12 matches the forward movement direction of the lower travel structure 11, that is, only when the swing angle is in the predetermined range; thus, it is possible to lessen computation load on the controller 43.

MC: Machine Control

The changeover determination section 81*i* is a device that acquires the relative swing angle between the upper swing structure 12 and the lower travel structure 11 computed by the posture computing section 43*b*, that determines the work device for which the MC is made valid out of the two work devices 1A and 1C on the basis of the relative swing angle, and that outputs the second input signal based on the determination to the display changeover section 81*f*.

A method of changing over the work device for which the MC is made valid between the two work devices 1A and 1C on the basis of the swing angle of the lower travel structure 11 with respect to the upper swing structure 12 is executed by the changeover determination section 81*i* similarly to the changeover of the work device subjected to the MG described previously.

Similarly to the previous changeover of the work device subjected to the MG, the swing angle being in the predetermined range is regarded as the case of which the frontward direction of the upper swing structure 12 matches the forward movement direction of the lower travel structure 11, while the swing angle being out of the predetermined range is regarded as the case of which the frontward direction of the upper swing structure 12 does not match the forward movement direction of the lower travel structure 11. In this case, when the swing angle is, for example, out of the predetermined range, the frontward direction of the upper swing structure 12 does not match the forward movement direction of the lower travel structure 11; thus, the changeover determination section 81*i* determines that work is being conducted by the front work device 1A and that the front work device 1A is subjected to the MC (MC is made valid for the front work device 1A). On the other hand, when the swing angle is in the predetermined range, the frontward direction of the upper swing structure 12 matches the forward movement direction of the lower travel structure 11; thus, the changeover determination section 81*i* determines that work is possibly conducted by the blade work device 1C and that the blade work device 1C is subjected to the MC.

As a result, when determining that the MC is valid for the front work device 1A, the changeover determination section 81*i* outputs the second input signal indicating the first pattern for making valid the MC over the front work device 1A to the control changeover section 81*f*. The solenoid proportional valve 44 thereby actuates the MC over the front work device 1A. Conversely, when determining that the MC is valid for the blade work device 1C, the changeover determination section 81*i* outputs the second input signal indicating the second pattern for making valid the MC over the blade work device 1C to the control changeover section 81*f*. The solenoid proportional valve 44 thereby actuates the MC over the blade work device 1C.

With the structure of Embodiment 3, causing the changeover determination section 81*i* to automatically output the second input signal on the basis of the swing angle of the lower travel structure 11 with respect to the upper swing structure 12 makes it possible to determine that the blade 16 is subjected to the MG without an operator's special operation when the frontward direction of the upper swing structure 12 is made to match the frontward direction of the lower travel structure 11 for conducting, for example, the blade work, thereby actuating the MC over the blade work device 1C. Thus, the work machine capable of executing the MC not only over the front work device 1A but also over the blade work device 1C can be realized. Furthermore, the blade position information and the target pilot pressure of the dozer cylinder 14 may be computed for the MG only when the frontward direction of the upper swing structure 12 matches the forward movement direction of the lower travel structure 11, that is, only when the swing angle is in the predetermined range; thus, it is possible to lessen computation load on the controller 43.

While the case of automatically changing over the work device subjected to the MG or the MC in response to the swing angle has been described above, the hydraulic excavator 1 may be structured such that a changeover switch or the like is provided within the cabin and that the work device subjected to the MG or the MC is changed over in response to an operation on the changeover switch or the like and the swing angle.

Functions and Advantages of Embodiments 1 to 3

(1) The hydraulic excavator according to Embodiments 1 to 3 includes: the two work devices 1A and 1C that change states of target work objects of the work devices 1A and 1C to other states; the operation devices 45, 46, and 49 for operating the two work devices 1A and 1C; the satellite communication antenna 25 that is a position sensor for detecting the position of the upper swing structure 12; the angle sensors 30, 31, 32, 33, 103, and 104 that are a plurality of posture sensors detecting the postures of the two work devices 1A and 1C; the position computing devices 81*a* and 81*b* that calculate the postures/positions of the two work devices 1A and 1C on the basis of the outputs from the satellite communication antenna 25 and the angle sensors 30, 31, 32, 33, 103, and 104; the display device 53 on which the position of at least one work device out of the two work devices 1A and 1C and the position of the target work object (target surface 60) of the at least one work device are displayed; a first signal generation device (display selection switch 96 or changeover determination section 81*i*) that generates the first input signal for determining a work device to be displayed on the display device 53 out of the two work devices 1A and 1C; and the display changeover section 81*c* that causes the work device designated by the first input signal input from the first signal generation device out of the two work devices 1A and 1C to be displayed and causes the position of the target work object (that is, position of the target work object of the work device designated by the first input signal input from the first signal generation device out of the two work devices 1A and 1C) to be displayed on the display device 53.

Structuring the hydraulic excavator in this way makes it possible to select the work device to be displayed on the display device 53 in response to a content of the first input signal generated by the display selection switch 96 or the changeover determination section 81*i*; thus, it is possible to execute the MG over the work device that is suited for the work content at that time and that is selected from between the two work devices 1A and 1C, and to improve work efficiency.

(2) The hydraulic excavator according to Embodiment 1 includes: the two work devices 1A and 1C that change the states of the target work objects of the two work devices 1A and 1C to the other states; the operation devices 45, 46, and 49 for operating the two work devices 1A and 1C; the satellite communication antenna 25 that is the position sensor for detecting the position of the upper swing structure 12; the angle sensors 30, 31, 32, 33, 103, and 104 that are the plurality of posture sensors detecting the postures of the two work devices 1A and 1C; the position computing devices 81*a* and 81*b* that calculate the postures/positions of the two work devices 1A and 1C on the basis of the outputs from the satellite communication antenna 25 and the angle sensors 30, 31, 32, 33, 103, and 104; the controllers 81*d* and 81*e* that execute machine control controlling to control actions of the two work devices 1A and 1C in such a manner that the bucket claw tip and the blade lower end, which are the control points of the two work devices 1A and 1C, are located above the target work objects (target surfaces 60) of the work devices 1A and 1C on the basis of the positions of the target work objects (target surfaces 60) and the positions of the two work devices 1A and 1C at a time of operating the operation devices 45, 46, and 47; a second signal generation device (control selection switch 97 or changeover determination section 81*i*) that generates the second input signal for determining a work device for which the machine control controlling is made valid out of the two work devices 1A and 1C; and the control changeover section 81*f* that makes valid the machine control controlling over the work device designated by the second input signal input from the second signal generation device out of the two work devices 1A and 1C.

Structuring the hydraulic excavator in this way makes it possible to select the work device for which the MC controlling is made valid in response to a content of the second input signal generated by the control selection switch 97 or the changeover determination section 81*i*; thus, it is possible to execute the MC over the work device that is suited for the work content at that time and that is selected from between the two work devices 1A and 1C, and to improve the work efficiency.

(3) The first signal generation device according to (1) is the display selection switch 96 that is used for the operator to select the work device 1A or 1C to be displayed on the display device 53 from between the two work devices 1A and 1C, the display selection switch 96 (display selection device) outputting the first input signal for displaying the work device selected by the operator on the display device 53 to the display changeover section 81*c*.

Structuring the hydraulic excavator in this way makes it possible to display the operator's desired work device on the display device 53 by selecting the work device using the switch 96; thus, it is possible to improve the work efficiency.

(4) The second signal generation device according to (2) is the control selection switch 97 that is used for the operator to select the work device 1A or 1C for which the machine control controlling is made valid from between the two work devices 1A and 1C, the control selection switch 97 (control selection device) outputting the second input signal for making valid the machine control over the work device selected by the operator to the control changeover section 81*f*.

Structuring the hydraulic excavator in this way makes it possible to make valid the machine control over the operator's desired work device by selecting the work device using the switch 96; thus, it is possible to improve the work efficiency.

(5) The hydraulic excavator according to Embodiment 2 includes: the two work devices 1A and 1C that form the target work objects of the work devices 1A and 1C; the operation devices 45, 46, and 49 for operating the two work devices 1A and 1C; the satellite communication antenna 25 that is the position sensor for detecting the position of the upper swing structure 12; the angle sensors 30, 31, 32, 33, 103, and 104 that are the plurality of posture sensors detecting the postures of the two work devices 1A and 1C; the position computing devices 81*a* and 81*b* that calculate the postures/positions of the two work devices 1A and 1C on the basis of the outputs from the satellite communication antenna 25 and the angle sensors 30, 31, 32, 33, 103, and 104; the display device 53 on which the position of at least one work device out of the two work devices 1A and 1C and the position of the target surface 60 of the at least one work device are displayed; the display changeover section 81*c* that changes over a work device to be displayed on the display device 53 between the two work devices 1A and 1C in accordance with the first input signal; the distance computing sections 81*g* and 81*h* that calculate the first distance Db which is the distance between the front work device 1A and the target surface 60 of the front work device 1A and the second distance Dd which is the distance between the blade work device 1C and the target surface 60 of the blade work device 1C; and the changeover determination section 81*i* that determines the work device to be displayed on the display device 53 out of the two work devices 1A and 1C on the basis of the first distance Db and the second distance Dd, and that outputs the first input signal based on the determination to the display changeover section 81*c*.

Structuring the hydraulic excavator in this way causes the work device suited for work to be automatically selected in response to the first distance Db and the second distance Dd and to be displayed on the display device 53; thus, it is possible to further improve the work efficiency, as compared with the case of (1).

(6) Furthermore, the hydraulic excavator according to Embodiment 2 includes: the two work devices 1A and 1C that form the target surfaces of the work devices 1A and 1C; the operation devices 45, 46, and 49 for operating the two work devices 1A and 1C; the satellite communication antenna 25 that is the position sensor for detecting the position of the upper swing structure 12; the angle sensors 30, 31, 32, 33, 103, and 104 that are the plurality of posture sensors detecting the postures of the two work devices 1A and 1C; the position computing devices 81*a* and 81*b* that calculate the postures/positions of the two work devices 1A and 1C on the basis of the outputs from the satellite communication antenna 25 and the angle sensors 30, 31, 32, 33, 103, and 104; the controllers 81*g* and 81*h* that execute the machine control controlling to control the actions of the two work devices 1A and 1C in such a manner that the bucket claw tip and the blade lower end, which are the control points of the two work devices 1A and 1C, are located above the target surfaces 60 of the work devices 1A and 1C on the basis of the positions of the target surfaces 60 and the positions of the two work devices 1A and 1C at the time of operating the operation devices 45, 46, and 47; the control changeover section 81*f* that changes over a work device for which the machine control controlling is made valid between the two work devices 1A and 1C in accordance with the second input signal; the distance computing sections 81*g* and 81*h* that calculate the first distance Db which is the distance between the front work device 1A and the target surface 60 of the front work device 1A and the second distance Dd which is the distance between the blade work device 1C and the target surface 60 of the blade work device 1C; and the changeover determination section 81*i* that determines the work device for which the machine control controlling is made valid out of the two work devices 1A and 1C on the basis of the first distance Db and the second distance Dd, and that outputs the second input signal based on the determination to the control changeover section 81*f*.

Structuring the hydraulic excavator in this way causes the work device suited for work to be automatically selected in response to the first distance Db and the second distance Dd to make the machine control valid; thus, it is possible to further improve the work efficiency, as compared with the case of (2).

(7) The hydraulic excavator according to Embodiment 3 includes: the two work devices 1A and 1C that form the target work objects of the work devices 1A and 1C; the operation devices 45, 46, and 49 for operating the two work devices 1A and 1C; the satellite communication antenna 25 that is the position sensor for detecting the position of the upper swing structure 12; the angle sensors 30, 31, 32, 33, 103, and 104 that are the plurality of posture sensors detecting the postures of the two work devices 1A and 1C; the position computing devices 81*a* and 81*b* that calculate the postures/positions of the two work devices 1A and 1C on the basis of the outputs from the satellite communication antenna 25 and the angle sensors 30, 31, 32, 33, 103, and 104; the display device 53 on which the position of at least one work device out of the two work devices 1A and 1C and the position of the target surface 60 of the at least one work device are displayed; the display changeover section 81*c* that changes over a work device to be displayed on the display device 53 between the two work devices 1A and 1C in accordance with the first input signal; and the changeover determination section 81*i* that acquires the relative swing angle between the upper swing structure and the lower travel structure via the angle sensor 104, that determines the work device to be displayed on the display device 53 out of the two work devices 1A and 1C on the basis of the relative swing angle, and that outputs the first input signal based on the determination to the display changeover section 81*c*.

Structuring the hydraulic excavator in this way makes it possible to execute control to determine the work device for which the MG is made valid on the basis of a value of the relative swing angle of the upper swing structure 12 or the lower travel structure 11. For example, if the hydraulic excavator is structured to display the blade work device 1C on the display device 53 only when the relative swing angle is in the predetermined range (for example, only when the frontward direction of the upper swing structure 12 matches the travelling direction of the lower travel structure 11), the blade position information may be computed for the MG only when the relative swing angle is in the predetermined range; thus, it is possible to lessen computation load on the controller 43.

Structuring the hydraulic excavator in this way causes the blade work device 1C to be automatically selected and to be displayed on the display device 53 when the frontward direction of the upper swing structure is made to match the travelling direction of the lower travel structure for conducting the blade work; thus, it is possible to further improve the work efficiency, as compared with the case of (1).

(8) Furthermore, the hydraulic excavator according to Embodiment 3 includes: the two work devices 1A and 1C that form the target surfaces of the work devices 1A and 1C; the operation devices 45, 46, and 49 for operating the two work devices 1A and 1C; the satellite communication antenna 25 that is the position sensor for detecting the position of the upper swing structure 12; the angle sensors 30, 31, 32, 33, 103, and 104 that are the plurality of posture sensors detecting the postures of the two work devices 1A and 1C; the position computing devices 81*a* and 81*b* that calculate the postures/positions of the two work devices 1A and 1C on the basis of the outputs from the satellite communication antenna 25 and the angle sensors 30, 31, 32, 33, 103, and 104; the controllers 81*g* and 81*h* that execute the machine control controlling to control the actions of the two work devices 1A and 1C in such a manner that the bucket claw tip and the blade lower end, which are the control points of the two work devices 1A and 1C, are located above the target surfaces 60 of the work devices 1A and 1C on the basis of the positions of the target surfaces 60 and the positions of the two work devices 1A and 1C at the time of operating the operation devices 45, 46, and 47; the control changeover section 81*f* that changes over a work device for which the machine control controlling is made valid between the two work devices 1A and 1C in accordance with the second input signal; and the changeover determination section 81*i* that acquires the relative swing angle between the upper swing structure and the lower travel structure via the angle sensor 104, that determines the work device for which the machine control controlling is made valid out of the two work devices 1A and 1C on the basis of the relative swing angle, and that outputs the second input signal based on the determination to the control changeover section 81*f*.

Structuring the hydraulic excavator in this way makes it possible to execute control to determine the work device for which the MC is made valid on the basis of the value of the relative swing angle between the upper swing structure 12 and the lower travel structure 11. For example, if the hydraulic excavator is structured to make valid the MC over the blade work device 1C only when the relative swing angle is in the predetermined range (for example, only when the frontward direction of the upper swing structure 12 matches the travelling direction of the lower travel structure 11), the blade position information and the target pilot pressure of the dozer cylinder 14 may be computed for the MC only when the relative swing angle is in the predetermined range; thus, it is possible to lessen the computation load on the controller 43.

Note

In Embodiment 1, the hydraulic excavator 1 may be structured such that the operator adds the display of the blade position to, for example, the screen of FIG. 10 and can simultaneously check the front work device 1A and the blade work device 1C by selecting the pattern 3 using the display selection switch 96. Furthermore, while a side view of viewing the machine body from a side surface direction is displayed in screen images of FIGS. 10 and 11, a view from the other direction such as a front view of the machine body may be displayed in the screen 400. Moreover, in displaying the work device 1A and 1C on the display device 53, it is not always necessary to display overviews of the work devices 1A and 1C. As long as the bucket 10 and the blade 16 are displayed, the display of the other parts may be optional.

In Embodiment 2, it may be determined that the two-work-devices target domain 707 in which the distances Db and Dd of the bucket 10 and the blade 16 to the target surface 60 are both long in the domains of FIG. 19 is in a situation of a little need to execute the MC over both of the two work devices 1A and 1C, and the MC over both of the work devices 1A and 1C may be made invalid. It is noted that a table for determining the work device subjected to the MG/MC from the combination of the bucket distance Db and the blade distance Dd is not limited to those depicted in FIGS. 18 and 19.

Furthermore, the hydraulic excavator 1 according to Embodiment 2 may be structured such that the switches 96 and 97 and devices associated with the switches 96 and 97 are provided similarly to Embodiment 1, and that the operator's desired work device is determined as the work device subjected to the MG/MC using the switches 96 and 97 in the holding domain 703 in FIGS. 18 and 19.

Moreover, in determining the work device subjected to the MG/MC from the combination of the distances Db and Dd, a ratio (Db/Dd) of the bucket distance Db to the blade distance Dd may be calculated, the front work device 1A may be determined as the work device subjected to the MG/MC in a case in which a value of the ratio is equal to or smaller than the inclination of the straight line 704, the work device subjected to the MG/MC may be determined to be held in a case in which the value of the ratio is greater than the inclination of the straight line 704 and smaller than the inclination of the straight line 705, and the blade work device 1C may be determined as the work device subjected to the MG/MC in a case in which the value of the ratio is equal to or greater than the straight line 705.

In Embodiment 3, the hydraulic excavator 1 may be simultaneously provided with a scheme of the changeovers of the work device by the switches in Embodiment 1 and a scheme of changeovers of the work device on the basis of the combination of the first distance Db and the second distance Db. For example, when the swing angle of the lower travel structure 11 with respect to the upper swing structure 12 is in the predetermined range and the switch is operated in such a manner as to display the blade work device 1C and to make valid the machine control over the blade 16, the blade work device 1C may be displayed on the display device 53 and the machine control over the blade work device 1C may be made valid. Alternatively, when the swing angle of the lower travel structure 11 with respect to the upper swing structure 12 is in the predetermined range and the combination of the distances Db and Dd enters the domain in which the blade work device 1C is displayed and the machine control over the blade 16 is made valid, the blade work device 1C may be displayed on the display device 53 and the machine control over the blade work device 1C may be made valid.

While the hydraulic excavator capable of executing the MG and the MC has been exemplarily described in Embodiments 1 to 3, the hydraulic excavator may be structured to be able to execute only one of the MG and MC. More specifically, in a case of a hydraulic excavator capable of executing only the MG, the operator's operation sensor 52*a*, the operation amount computing section 43*a*, the front device control section 81*d*, the blade control section 81*e*, the control changeover section 81*f*, the control selection switch 97, and the solenoid proportional valve control section 44 may be optional in the structure of FIG. 9. In addition, in a case of a hydraulic excavator capable of executing only the MC, the display selection switch 96 and the display changeover section 81*c* may be optional in FIG. 9.

While only the dozer cylinder 14 that vertically moves the blade 16 is subjected to the MC in the blade work device 1C described above, the blade work device 1C may be provided with a tilt cylinder that causes a tilting action of the blade 16 and an angle cylinder that causes an angling action of the blade 16, and may execute the MC over these cylinders in such a manner that the lower end of the blade 16 moves along the target surface.

While the hydraulic excavator provided with the two work devices, that is, the front work device and the blade work device has been described above, the present invention is also applicable to a work machine provided with three or more work devices. Examples of the work device of this type include a so-called dual arm work machine provided with two front work devices attached to left and right sides of an upper swing structure and a blade work device attached to a front of the lower travel structure.

A part of or all of the structures related to the controller 40 and functions, execution processes, and the like of the structures may be realized by hardware (by designing logic for executing each function, for example, by an integrated circuit, or the like). Furthermore, the structures related to the controller 40 may be implemented as a program (software) for realizing the functions related to the structures of the controller 40 by causing a computing processor (for example, a CPU) to read and execute the program. Information related to the program can be stored in, for example, a semiconductor memory (such as a flash memory or an SSD), a magnetic storage device (such as a hard disk drive), or a recording medium (such as a magnetic disk or an optical disk).

DESCRIPTION OF REFERENCE CHARACTERS

Db: First distance (bucket distance)
Dd: Second distance (blade distance)
1A: Front work device
1C: Blade work device
8: Boom
9: Arm
10: Bucket
16: Blade
17: Machine control ON/OFF switch
25*a*, 25*b*: Satellite communication antenna
30: Boom angle sensor
31: Arm angle sensor
32: Bucket angle sensor
40: Controller (controller)
43: MG/MC Control section
43*a*: Operation amount computing section
43*b*: Posture computing section
43*c*: Target surface computing section
43*z*: Swing structure position computing section
44: Solenoid proportional valve controller
45: Operation device (for boom and arm)
46: Operation device (for bucket and swing)
47: Operation device (for travelling)
49: Operation device (for blade)
50: Work device posture sensor
51: Target surface setting device
52*a*: Operator's operation sensor
53: Display device
54, 55, 56: Solenoid proportional valve
81*a*: Front device position computing section
81*b*: Blade position computing section
81*c*: Display changeover section
81*d*: Front device control section
81*e*: Blade control section
81*f*: Control changeover section
81*g*: Front device distance computing section
81*h*: Blade distance computing section
81*i*: Changeover determination section
96: Display selection switch
97: Control selection switch

The invention claimed is:

1. A work machine including:

a plurality of work devices;

an operation device for operating the plurality of work devices;

a position sensor that detects a position of a machine body to which the plurality of work devices are attached;

a plurality of posture sensors that detect postures of the plurality of work devices; and a controller having a position computing device that calculates positions of the plurality of work devices on the basis of outputs from the position sensor and the plurality of posture sensors, wherein the work machine comprises:

a display device on which a position of at least one work device among the plurality of work devices and a position of a target work object of the at least one work device are displayed; and a display selection device that is used for an operator to select a work device to be displayed on the display device from among the plurality of work devices, the display selection device outputting a first input signal for causing the work device selected by the operator to be displayed on the display device, and the controller further includes a display changeover section that selectively causes the work device corresponding to the first input signal input from the display selection device among the plurality of work devices to be displayed and causes the position of the target work object of the work device corresponding to the first input signal input from the display selection device to be displayed on the display device.

2. The work machine according to claim 1, wherein the controller includes:

a work device control section that executes machine control controlling to control actions of the plurality of work devices in such a manner that control points of the plurality of work devices are located above a plurality of target work objects of the plurality of work devices, on the basis of the plurality of work devices and positions of the plurality of target work objects of the plurality of work devices at a time of operating the operation device; and a control changeover section that changes over a work device for which the machine control controlling is made valid among the plurality of work devices in accordance with a second input signal.

3. The work machine according to claim 2, further comprising a control selection device that is used for the operator to select the work device for which the machine control controlling is made valid from among the plurality of work devices, the control selection device outputting the second input signal for making valid the machine control controlling over the work device selected by the operator to the control changeover section.

4. The work machine according to claim 1, wherein the plurality of work devices include a front work device and a blade work device, the plurality of target work objects include a plurality of target surfaces, and the controller includes:

a distance computing section that calculates a first distance which is a distance between the front work device and a target surface of the front work device and a second distance which is a distance between the blade work device and a target surface of the blade work device; and a changeover determination section that determines a work device to be displayed on the display device out of the plurality of work devices on the basis of the first distance and the second distance, and that outputs the first input signal based on a determination to the display changeover section.

5. The work machine according to claim 2, wherein the plurality of work devices include a front work device and a blade work device, the plurality of target work objects include a plurality of target surfaces, and the controller includes:

a distance computing section that calculates a first distance which is a distance between the front work device and a target surface of the front work device and a second distance which is a distance between the blade work device and a target surface of the blade work device; and a changeover determination section that determines the work device for which the machine control controlling is made valid out of the plurality of work devices on the basis of the first distance and the second distance, and that outputs the second input signal based on a determination to the control changeover section.

6. The work machine according to claim 5, wherein the changeover determination section further determines the work device to be displayed on the display device out of the plurality of work devices on the basis of the first distance and the second distance, and outputs the first input signal based on a determination to the display changeover section.

7. The work machine according to claim 1, wherein the work machine includes an upper swing structure and a lower travel structure, the plurality of work devices include a front work device and a blade work device, the front work device is attached to the upper swing structure, the blade work device is attached to the lower travel structure, the plurality of target work objects include a plurality of target surfaces, and the controller includes a changeover determination section that determines the work device to be displayed on the display device out of the plurality of work devices on the basis of a relative swing angle between the upper swing structure and the lower travel structure, and that outputs the first input signal based on a determination to the display changeover section.

8. The work machine according to claim 2, wherein the work machine includes an upper swing structure and a lower travel structure, the plurality of work devices include a front work device and a blade work device, the front work device is attached to the upper swing structure, the blade work device is attached to the lower travel structure, the plurality of target work objects include a plurality of target surfaces, and the controller includes a changeover determination section that determines the work device for which the machine control controlling is made valid out of the plurality of work devices on the basis of a relative swing angle between the upper swing structure and the lower travel structure, and that outputs the second input signal based on a determination to the control changeover section.

9. The construction machine according to claim 8, wherein the changeover determination section further determines a work device to be displayed on the display device out of the plurality of work devices on the basis of the relative swing angle between the upper swing structure and the lower travel structure, and outputs the first input signal based on a determination to the display change-over section.

* * * * *